US006522856B2

(12) United States Patent
Nakayama

(10) Patent No.: US 6,522,856 B2
(45) Date of Patent: Feb. 18, 2003

(54) IMAGE FORMING APPARATUS INCLUDING BEARING AND CONVEYING MEMBER WITH EXCESSIVE-WEAR PREVENTION PROPERTIES

(75) Inventor: Yuji Nakayama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/835,586

(22) Filed: Apr. 17, 2001

(65) Prior Publication Data

US 2002/0009314 A1 Jan. 24, 2002

(30) Foreign Application Priority Data

Apr. 20, 2000 (JP) ..... 2000-119063
Apr. 20, 2000 (JP) ..... 2000-119064
Apr. 20, 2000 (JP) ..... 2000-119065

(51) Int. Cl.[7] ..... G03G 15/16; G03G 15/01; G03G 21/00

(52) U.S. Cl. ..... 399/297; 399/302; 399/350

(58) Field of Search ..... 399/302, 303, 399/308, 350, 351, 297

(56) References Cited

U.S. PATENT DOCUMENTS 3,660,862 A * 5/1972 Gerbasi ..... 399/351
5,121,166 A * 6/1992 Miyamoto et al. ..... 399/350 X
5,321,483 A * 6/1994 Yokoyama et al. ..... 399/351
5,873,018 A * 2/1999 Aoto et al. ..... 399/302
5,978,644 A * 11/1999 Sato et al. ..... 399/302 X
6,055,404 A 4/2000 Yamazaki et al. ..... 399/350
6,101,360 A * 8/2000 Hard et al. ..... 399/308
6,160,980 A * 12/2000 Ziegelmuller et al. ..... 399/303
6,223,015 B1 * 4/2001 Takahata et al. ..... 399/302

* cited by examiner

*Primary Examiner*—Fred L Braun
(74) *Attorney, Agent, or Firm*—Fitzpatrick, Cella, Harper & Scinto

(57) ABSTRACT

An image forming apparatus provided with an image forming portion for forming an image by a developer, a bearing and conveying member capable of bearing thereon and conveying a transfer material on which the developer image is formed, or the developer image directly transferred thereto, and a cleaning portion for cleaning the bearing and conveying member, the cleaning portion has a cleaning blade abutting against the bearing and conveying member, and a holding member holding the cleaning blade and swingable about a rotary shaft, wherein the angle formed by a tangential line on the abutting portion of the cleaning blade against the bearing and conveying member with a line connecting the center of the rotary shaft and the abutting portion is designed to be equal to or greater than 0° and equal to or smaller than 15°, and the abrasion wear of the surface of the bearing and conveying member when in use of the apparatus, the bearing and conveying member has made 10,000 revolutions is designed to be equal to or greater than 0.01 μm and equal to or less than 1.0 μm.

23 Claims, 8 Drawing Sheets

| | TRANSFER BELT | | | | | CLEANING BLADE | | ABRASION WEAR OF TRANSFER BELT [μm/TEN THOUSAND REVOLUTIONS] | IMAGE PERFORMANCE |
|---|---|---|---|---|---|---|---|---|---|
| | MATERIAL | TENSILE STRENGTH [kgf/cm²] | YOUNG'S MODULUS [kgf/cm²] | COEFFICIENT OF DYNAMIC FRICTION (INITIALNESS) | SWING FULCRUM ANGLE θ [°] | MODULUS OF REPULSION ELASTICITY [%] | HARDNESS [°] | | |
| EMBODIMENT | | | | | | | | | |
| 1 | PI | 3200 | $6.00\times10^4$ | $3.00\times10^{-1}$ | 0 | 45 | 77 | 0.05 | MILLION SHEETS ○ |
| 2 | PI | 4000 | $7.00\times10^4$ | $2.00\times10^{-1}$ | 0 | 45 | 77 | 0.3 | MILLION SHEETS ○ |
| 3 | PI | 3200 | $6.00\times10^4$ | $3.00\times10^{-1}$ | 10 | 30 | 70 | 0.05 | MILLION SHEETS ○ |
| COMPARATIVE EXAMPLE | | | | | | | | | |
| 1 | PI | 3200 | $6.00\times10^4$ | $3.00\times10^{-1}$ | 30 | 45 | 77 | – | BLADE TURNING UP |
| 2 | PI | 3200 | $6.00\times10^4$ | $3.00\times10^{-1}$ | −15 | 45 | 77 | – | TONER PASSING IN START UP |
| 3 | PC | 660 | $2.00\times10^4$ | $3.00\times10^{-1}$ | 0 | 45 | 77 | 2 | HUNDRED THOUSAND SHEETS × |

○: GOOD, ×: BAD

FIG. 4

| | TRANSFER BELT | | | | | CLEANING BLADE | | ABRASION WEAR OF TRANSFER BELT [μm/TEN THOUSAND REVOLUTIONS] | IMAGE PERFORMANCE |
|---|---|---|---|---|---|---|---|---|---|
| | MATERIAL | TENSILE STRENGTH [kgf/cm²] | YOUNG'S MODULUS [kgf/cm²] | COEFFICIENT OF DYNAMIC FRICTION (INITIALNESS) | SWING FULCRUM ANGLE θ [°] | MODULUS OF REPULSION ELASTICITY [%] | HARDNESS [°] | | |
| EMBODIMENT | | | | | | | | | |
| 1 | PI | 3200 | $6.00\times10^{4}$ | $3.00\times10^{-1}$ | 0 | 45 | 77 | 0.05 | MILLION SHEETS ○ |
| 2 | PI | 4000 | $7.00\times10^{4}$ | $2.00\times10^{-1}$ | 0 | 45 | 77 | 0.3 | MILLION SHEETS ○ |
| 3 | PI | 3200 | $6.00\times10^{4}$ | $3.00\times10^{-1}$ | 10 | 30 | 70 | 0.05 | MILLION SHEETS ○ |
| COMPARATIVE EXAMPLE | | | | | | | | | |
| 1 | PI | 3200 | $6.00\times10^{4}$ | $3.00\times10^{-1}$ | 30 | 45 | 77 | – | BLADE TURNING UP |
| 2 | PI | 3200 | $6.00\times10^{4}$ | $3.00\times10^{-1}$ | −15 | 45 | 77 | – | TONER PASSING IN START UP |
| 3 | PC | 660 | $2.00\times10^{4}$ | $3.00\times10^{-1}$ | 0 | 45 | 77 | 2 | HUNDRED THOUSAND SHEETS × |

○: GOOD, ×: BAD

FIG. 7

| | TRANSFER BELT | | | | | CLEANING BLADE | | ABRASION WEAR OF TRANSFER BELT [μm/TEN THOUSAND REVOLUTIONS] | IMAGE PERFORMANCE |
|---|---|---|---|---|---|---|---|---|---|
| | MATERIAL | TENSILE STRENGTH [kgf/cm²] | YOUNG'S MODULUS [kgf/cm²] | INITIAL SURFACE ROUGHNESS [μm] | SURFACE ROUGHNESS AFTER ENDURANCE TEST [μm] | MODULUS OF REPULSION ELASTICITY [%] | HARDNESS [°] | | |
| EMBODIMENT | | | | | | | | | |
| 5 | PI | 3200 | $6.00\times10^4$ | 0.92 | 1.03 | 45 | 77 | 0.05 | MILLION SHEETS ○ |
| 6 | PI | 1500 | $3.20\times10^4$ | 0.32 | 0.41 | 45 | 77 | 0.3 | MILLION SHEETS ○ |
| 7 | PI | 3200 | $6.00\times10^4$ | 0.92 | 0.78 | 30 | 70 | 0.05 | MILLION SHEETS ○ |
| COMPARATIVE EXAMPLE | | | | | | | | | |
| 5 | PC | 660 | $2.00\times10^4$ | 0.60 | 4.50 | 45 | 77 | 2 | HUNDRED THOUSAND SHEETS × |
| 6 | PI | 3200 | $6.00\times10^4$ | 0.92 | – | 10 | 70 | – | LOW TEMPERATURE × |
| 7 | PI | 140000 | $2.90\times10^4$ | 1.80 | – | 45 | 77 | – | LOW TEMPERATURE × |

○: GOOD, ×: BAD

FIG. 8

| | TRANSFER BELT | | | CLEANING BLADE | | ABRASION WEAR OF TRANSFER BELT [μm/TEN THOUSAND REVOLUTIONS] | IMAGE PERFORMANCE |
|---|---|---|---|---|---|---|---|
| | MATERIAL | TENSILE STRENGTH [kgf/cm²] | YOUNG'S MODULUS [kgf/cm²] | MODULUS OF REPULSION ELASTICITY [%] | HARDNESS [°] | | |
| EMBODIMENT | | | | | | | |
| 8 | PI | 3200 | $6.00\times10^4$ | 45 | 77 | 0.05 | MILLION SHEETS ○ |
| 9 | PI | 1500 | $3.20\times10^4$ | 45 | 77 | 0.3 | MILLION SHEETS ○ |
| 10 | PI | 3200 | $6.00\times10^4$ | 30 | 70 | 0.05 | MILLION SHEETS ○ |
| COMPARATIVE EXAMPLE | | | | | | | |
| 8 | PC | 660 | $2.00\times10^4$ | 45 | 77 | 2 | HUNDRED THOUSAND SHEETS × |
| 9 | PI | 3200 | $6.00\times10^4$ | 10 | 70 | – | LOW TEMPERATURE × |

○: GOOD, ×: BAD

IMAGE FORMING APPARATUS INCLUDING BEARING AND CONVEYING MEMBER WITH EXCESSIVE-WEAR PREVENTION PROPERTIES

BACKGROUND OF THE INVENTION

1. Field of the Invention

This invention relates to an image forming apparatus using the electrophotographic process such as a copier, a printer or a facsimile apparatus, and particularly to cleaning means for a transfer material or developer image bearing and conveying member in the image forming apparatus.

2. Related Background Art

In recent years, compound machines having all of output terminals such as a copier, a printer and a facsimile apparatus have come to be widely accepted in the market. Image forming apparatuses using the electrophotographic process have been widely accepted as such output terminals coping with the network, but the limited number of sheets for which the main body continues to operate normally without maintenance, i.e., the so-called duty cycle, has been mentioned as a great problem. The greatest rate controlling of the duty cycle is the life of an image bearing member, and from the viewpoint of ecology, it has become a great task to eliminate waste, that is, the decrease expendables, to extend the lives of the expendable, improve reliability, etc.

Also, the digitization of conventional analog apparatuses has been advanced, and it has also become a task to make the cost of the main body equivalent to or less than that of the analog apparatus. Further, black-and-white machines have been in the mainstream not only in conventional copiers and printers, but in offices as well, the full coloration of originals or output files is increasing rapidly. Accordingly, not only the digital machines equivalent to black-and-white printers, reducing the cost of the main body and running cost has become a task. For this reason, there has been desired a technique which can epoch-makingly reduce TCO (total cost of owners, i.e., total necessary cost as viewed from the user).

In such a situation, in recent years, the mainstream has been occupied by a color image forming apparatus which is provided with a plurality of photo-sensitive drums and a transfer belt for bearing and conveying a recording material, and sequentially superimposes and transfers toner images of different colors formed on the respective photosensitive drums to the recording material borne on the transfer belt to thereby obtain a color image, i.e., a so-called four-station tandem type color image forming apparatus.

Also, in the above-described image forming apparatus, various adhering materials (such as toners scattering from the photosensitive drums, toners transferred from the photosensitive drums during jam or at the time between a sheet and a sheet, and mold releasing oil adhering to the recording material during the toner image fixation on a first surface when image formation is effected on a second surface of the recording material) adhere onto the transfer belt as a recording material bearing member and therefore, it has been proposed to provide as cleaning means a counter blade system, a fur brush system, an oil cleaner roller for removing the mold releasing oil, an oil cleaner web or the like. There has also been proposed a toner manufactured by the polymerizing method having oil internally added which need not use such mold releasing oil.

An example of such image forming apparatus in which a recording material such as paper is attracted to and conveyed by a transfer belt (endless belt) as a recording material bearing member and image formation is effected will now be described briefly with reference to FIG. 6 of the accompanying drawings.

The image forming apparatus is provided with a photosensitive drum 205 therein, and a toner image is formed on the photosensitive drum 205. A transfer belt 206 as a recording material bearing member is installed adjacent to the photosensitive drum 205, and the toner image formed on the photosensitive drum 205 is transferred onto a recording material P borne on and conveyed by the transfer belt 206. The recording material P to which the toner image has been transferred has the toner image thereon fixed by heating and pressurizing in a fixing device 209, whereafter it is discharged out of the apparatus as a recorded image.

An exposure lamp 201, a photosensitive drum charger 202, an exposure device 203, a developing device 204, a transfer charger 207 and a cleaner 208 are provided around the photosensitive drum 205, and although not shown, a light source device and a polygon mirror are further installed in the upper portion of the apparatus.

A laser beam emitted from the light source device is scanned by the rotating polygon mirror, and the scanned beam is deflected by a reflecting mirror, and is condensed on the generatrix of the photosensitive drum 205 by an fΘ lens and the photosensitive drum 205 is exposed to the light, whereby a latent image conforming to an image signal is formed on the photosensitive drum 205.

The developing device 204 is filled with a predetermined amount of toner by a toner supplying device, not shown. The developing device 204 develops the latent image on the photosensitive drum 205 and visualizes it as a toner image.

The recording material P is contained in a recording material cassette, not shown, and is supplied therefrom to the transfer belt 206 via a plurality of conveying rollers and registration rollers 213, and is sequentially fed to a transfer position opposed to the photosensitive drum 205 by the conveyance by the transfer belt 206.

The transfer belt 206 is formed of a material comprising a dielectric material resin sheet such as a polycarbonate resin sheet, a polyethylene terephthalate resin sheet (PET resin), a polyvinylidene fluoride resin sheet, a polyurethane resin sheet, a polyamide resin sheet or a polyimide resin sheet having a resin filler such as carbon black dispersed therein, and having its volume resistivity adjusted to the order of $10^7$–$10^{15}$ Ωcm, and use is made of a belt having its opposite end portions superposed upon each other and joined together, and made into an endless shape, or a belt having no seam (seamless).

This transfer belt 206 is rotated by a driving roller 211 and when it reaches a predetermined speed, the recording material P is fed out from the registration rollers 213 to the transfer belt 206, and the recording material P is conveyed toward the transfer position. At the same time, an image writing signal becomes ON, and with it as the reference, image formation is effected on the photosensitive drum 205 at predetermined timing. Then, at the transfer position under the photosensitive drum 205, the transfer charger 207 imparts an electric field or charges, whereby the toner image formed on the photosensitive drum 205 is transferred to the recording material P. The recording material P, when fed out from the registration rollers 213 onto the transfer belt 206, is immediately nipped with the transfer belt 206 by and between an attracting charger 214 and an attracting charger opposite roller 215, and an electric field or charges are induced by the attracting charger 214, whereby the recording material P is electrostatically held on and conveyed by the transfer belt 206.

As the transfer charger 207, use is made of a non-contact charger such as a corona discharger, or a contact charger using a charging member such as a charging roller, a charging brush or a charging blade. The non-contact charger suffers from the problem that ozone is created, and the problem that charging is done through the air and therefore such charger is weak to the environmental fluctuations of temperature and humidity and images are not formed stably. On the other hand, the contact charger has the merit that ozone is not created and the charger is strong to the environmental fluctuations of temperature and humidity.

Next, the recording material P to which the toner image has been transferred has its charges eliminated in the downstream portion of the transfer belt 206 with respect to the direction of conveyance by a separating charger 216 and has its electrostatic attraction attenuated, whereby it leaves the distal end of the transfer belt 206. Particularly in a low humidity environment, the recording material is dry and electrical resistance becomes high and therefore, the electrostatic attraction between it and the transfer belt becomes great, and the effect of the separating charger 216 becomes great. Usually, the separating charger 216 eliminates the charges of the recording material P with the toner image thereon unfixed and therefore, a non-contact charger is used as the separating charger. As the output of the separating charger 216, use is made of an AC voltage of the order of Vp−p=10 kV and 500 Hz. Also, in order to prevent a bad image such as the scattering of the toner, a plus or minus DC component of the order of 100 $\mu$A is sometimes superimposed on the aforementioned AC output.

The recording material P having left the distal end of the transfer belt 206 is conveyed to the fixing device 209. The fixing device 209 is comprised of a fixing roller, a pressure roller, a heat-resisting cleaning member for cleaning each of them, a heater installed in each roller, an applying roller for applying mold releasing oil such as dimethyl silicon oil to the fixing roller, a reservoir for the oil and a thermistor for detecting the surface temperature of the pressure roller and controlling the fixing temperature. The toner image formed on the recording material P is fixed on the recording material P by fixing, whereby a copy image is formed, and the recording material P is discharged onto a discharge tray.

After the transfer has been completed, the photosensitive drum 205 has any untransferred toner thereon removed by the cleaner 208, and is continuedly prepared for the next latent image formation.

The transfer belt 206 after the recording material P has been separated therefrom is being contacted by an electrically conductive fur brush 210 grounded to the recording material bearing side and the driving roller 211 grounded as a member opposed thereto to thereby remove any toner residual on the transfer belt 206 and other foreign substances and eliminate the accumulated charges thereon. As the electrically conductive fur brush 210, use can also be made of an electrically conductive web (unwoven fabric).

Further, numerous propositions have heretofore been made as the cleaning means, but means for scraping off the residual toner by a cleaning blade formed of an elastic material such as urethane rubber is simple and compact in construction and low in cost and moreover excellent in the toner removing function and therefore is widely put into practical use. As the rubber material of this cleaning blade, use is generally made of urethane rubber having high hardness and moreover rich in elasticity and excellent in wear resistance, mechanical strength, oil-resisting property, ozone-resisting property, etc.

While in the image forming apparatus as described above, a pair of rollers comprising the attracting charger 214 and the attracting charger opposite roller 215 are used as electrostatic attracting means for the recording material P, a non-contact charger such as a corona discharger or a contact charger using a charging member such as a charging roller, a charging brush or a charging blade may of course be used as the electrostatic attracting means as in the case of the transfer charging means. However, when the non-contact system is used, the state of contact between the recording material P and the transfer belt 206 is not ensured and therefore, it is necessary to provide a pressure member discretely to thereby secure the close contact between the recording material P and the transfer belt 206.

To effect it stably to electrostatically attract and convey the recording material P as described above, the attraction and charging of the entire width of the recording material P is necessary as a matter of course.

However, there are the following problems when as in the above-described example of the conventional art, a cleaning blade which contacts with the surface of the transfer belt 206 to thereby effect cleaning is used as the cleaning means for the transfer belt 206.

Firstly, it has been confirmed by an experiment that the frictional force by the cleaning blade between the transfer belt and the residual substances on the transfer belt is increased by endurance. This is considered to be that the degree of close contact and affinity between the cleaning blade and the surface of the transfer belt rise by the filming film on the surface of the transfer belt formed by endurance and raise the frictional force. This rise of the frictional force is considered to mean that the shearing stress of the cleaning blade, the shearing stress between the toners and the shearing stress near the surface of the transfer belt rise.

As the result, it is considered to lead to the turning-up (wire edge) of the cleaning blade, the chipping (localized edge breakage) of the cleaning blade, the occurrence of the fusing bond of the toner by an increase in the amount of generated heat by an increase in permanent strain shearing stress, and the occurrence of an increase in the fatigue wear by such an increase in the internal stress of the transfer belt as leads to the breakage of the transfer belt. Also, by an increase in the frictional force, there comes out the possibility of the driving load of the transfer belt increasing to thereby hinder the operation of driving a motor. Also, if the abrasion wear of the transfer belt becomes great, there is the possibility that the film thickness of the transfer belt itself decreases and the interchange of the transfer belt must be done frequently.

Secondly, in recent years, the above-described image forming apparatus has come to be widely used not only as the function of only a copier, but as a printer as described above. Also, the repletion of applications such as the feeder function and the sorter function has been advanced and a continues operation for 4,000 sheets or more has become possible as a job. For example, in the case of a 50 sheets/A4 machines, a continuous operation is performed for 80 minutes or longer if simply calculated. Under such a situation, it is considered that the atmospheric temperature near the cleaning blade reaches nearly 50° C. and the contact (nip) portion between the cleaning blade and the surface of the photosensitive drum reaches a temperature higher than that. This leads to the problem that the frequency with which the adhesion or agglutination of the residual substances occurs on the surface of the transfer belt becomes high and the coefficient of friction g of the surface of the transfer belt is caused to rise.

Thirdly, as the particle diameter of the toner becomes smaller, development excellent in dot reproducibility and resolution can be accomplished and the sharpness and quality of toner images are improved, but again in this case, the specific surface area becomes large and therefore, the adhesion of the toner per unit weight to the transfer belt becomes great and the cleanability of the transfer belt may be aggravated. As the particle diameter of the toner becomes still smaller, the fluidity of the toner is aggravated and therefore, a greater amount of additive is required, and this leads to the problem that the wear or breakage of the cleaning blade as noted above and the localized streaky scratches on the surface of the transfer belt occur.

Fourthly, in recent years, polymer toner is being diversified for the improvement in transfer efficiency and the elimination of a releasing agent in fixation. However, the toner manufactured by the polymerizing method is generally high in sphericity. If this sphericity increases, the slipping-out of the toner may often occur in the heretofore generally used counter blade system to thereby cause localized shearing forces to be applied to the cleaning blade and cause the edge breakage of the blade.

SUMMARY OF THE INVENTION

So, the present invention has been made in view of the above-noted problems and the object thereof is to provide an image forming apparatus in which the excessive wear of a bearing and conveying member is prevented and yet a stable cleaning operation can be performed.

The image forming apparatus of the present invention for achieving the above object is provided with image forming means for forming an image by a developer, a bearing and conveying member capable of bearing thereon and conveying a transfer material on which the developer image is formed or the developer image directly transferred thereto, and cleaning means for cleaning the bearing and conveying member, the cleaning means having a cleaning blade abutting against the bearing and conveying member, and holding means holding the cleaning blade and swingable about a rotary shaft, wherein the angle formed by a tangential line on the abutting portion of the cleaning blade against the bearing and conveying member and a line linking the center of the rotary shaft and the abutting portion together is designed to be equal to or greater than 0° and equal to or smaller than 15°, wherein said bearing and conveying member has physical property values of a Young's modulus of $2.5\times10^4$ kgf/cm$^2$ or greater and a tensile strength of 1,000 kgf/cm$^2$ or greater, and the abrasion wear of the surface of the bearing and conveying member when in the used state of the apparatus, the bearing and conveying member has made 10,000 revolutions is equal to or greater than 0.01, $\mu$and equal to or less than 1.0 $\mu$m.

Another preferred form of the image forming apparatus is provided with image forming means for forming an image by a developer, a bearing and conveying member capable of bearing thereon and conveying a transfer material on which the developer image is formed on the developer image directly transferred thereto, and cleaning means for cleaning the bearing and conveying member, wherein the cleaning means is such that the abutting pressure of the cleaning blade thereof abutting against the bearing and conveying member is equal to or greater than 15 gf/cm and equal to or less than 100 gf/cm, the initial surface roughness Rz of the bearing and conveying member is equal to or greater than 0.01 $\mu$m and equal to or less than 1.0 $\mu$m, wherein said bearing and conveying member has physical property values of a Young's modulus of $2.5\times10^4$ kgf/cm$^2$ or greater and a tensile strength of 1,000 kgf/cm$^2$ or greater, and the surface roughness Rz of the bearing and conveying member when in the used state of the apparatus, the bearing and conveying member has made 10,000 revolutions is equal to or greater than 0.01 $\mu$m and equal to or less than 1.5 $\mu$m.

Still another form of the image forming apparatus is provided with image forming means for forming an image by a developer, a bearing and conveying member capable of bearing thereon and conveying a transfer material on which the developer image is formed or the developer image directly transferred thereto, and cleaning means for cleaning the bearing and conveying member, wherein the cleaning means is such that the abutting pressure of the cleaning blade thereof abutting against the bearing and conveying member is equal to or greater than 15 gf/cm and equal to or less than 100 gf/cm, wherein said bearing and conveying member has physical property values of a Young's modulus of $2.5\times10^4$ kgf/cm$^2$ or greater and a tensile strength of 1,000 kgf/cm$^2$ or greater, and the abrasion wear of the surface of the bearing and conveying member when in the used state of the apparatus, the bearing and conveying member has made 10,000 revolutions is equal to or greater than 0.01 $\mu$m and equal to or less than 1.0 $\mu$m.

BRIEF DESCRIPTION OF THE DRAWINGS

FIG. 4 is a first table representing the relation among the transfer belt, the cleaning blade and abrasion wear and the result of an endurance test.

FIG. 7 is a second table representing the relation among the transfer belt, the cleaning blade and abrasion wear and the result of an endurance test.

FIG. 8 is a third table representing the relation among the transfer belt, the cleaning blade and abrasion wear and the result of an endurance test.

DESCRIPTION OF THE PREFERRED EMBODIMENTS

Figure 1:
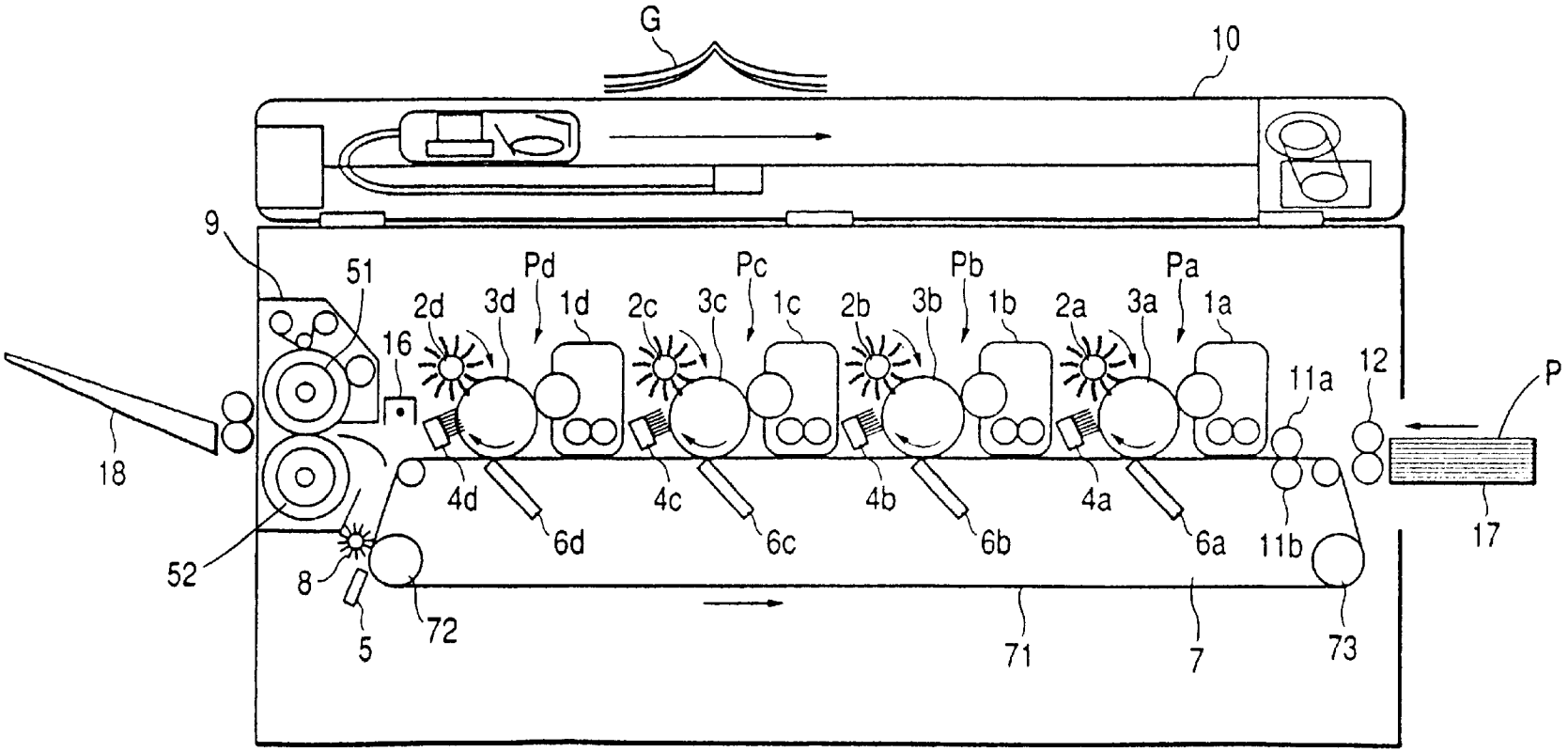
FIG. 1 is a typical cross-sectional view schematically showing the construction of an image forming apparatus according to the present invention.
Figure 2:
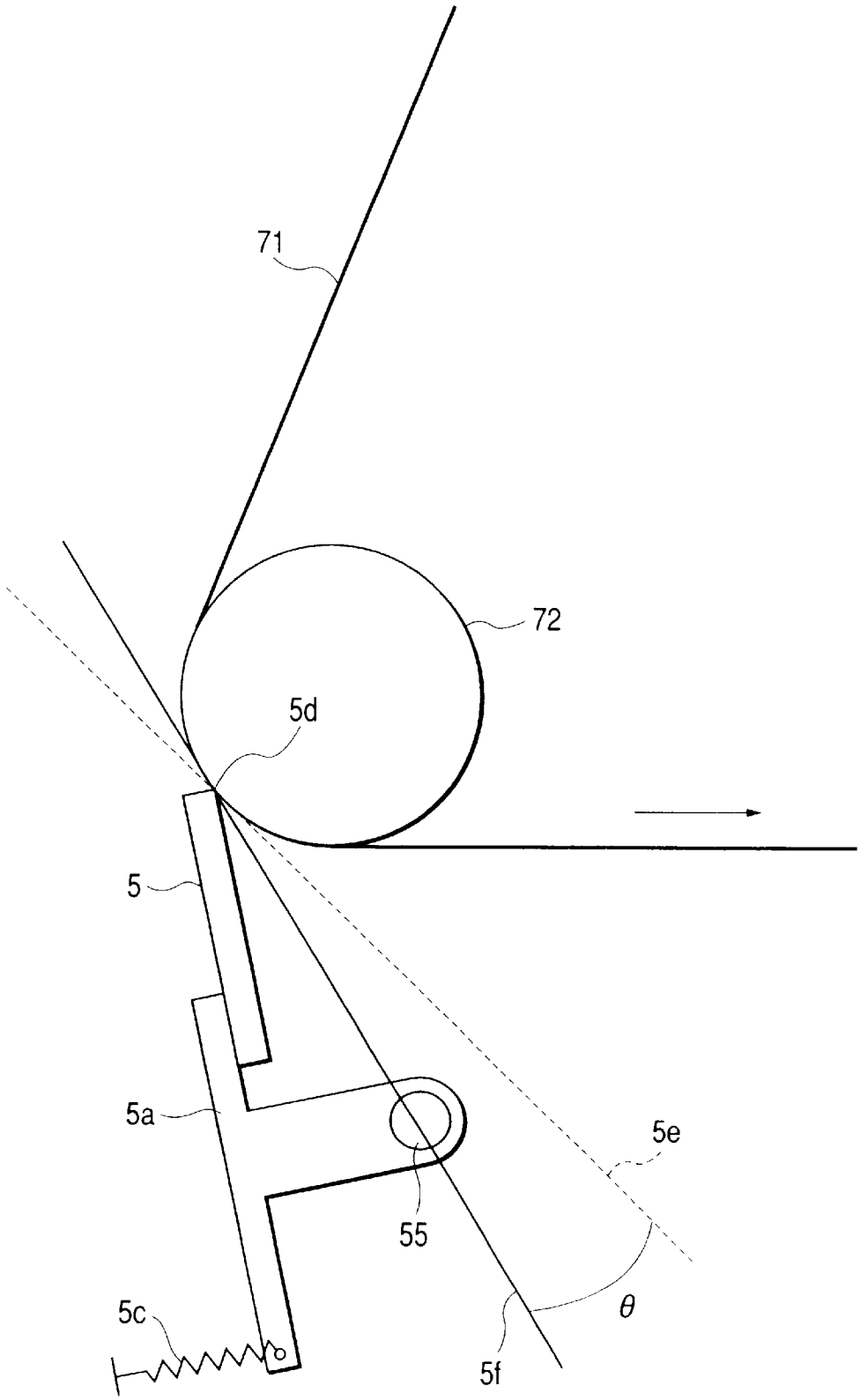
FIG. 2 is an illustration representing the relation between a transfer belt and a cleaning blade.

Some embodiments of an image forming apparatus to which the present invention is applied will hereinafter be described in detail with reference to the drawings.

[First Embodiment]

An image forming apparatus according to a first embodiment will be briefly described with reference to FIGS. 1 to 4.

First, second, third and fourth image forming stations Pa, Pb, Pc and Pd are juxtaposed in the apparatus, and toner images of different colors are formed by way of the processes of latent images, development and transfer.

The image forming stations Pa, Pb, Pc and Pd are provided with electrophotographic photosensitive drums 3*a*, 3*b*, 3*c* and 3*d* which are dedicated image bearing members, and toner images of respective colors are formed on the photosensitive drums 3*a*, 3*b*, 3*c* and 3*d*. A transfer belt 71 as a bearing and conveying member (recording material bearing member) is installed adjacent to the photosensitive drums 3*a*, 3*b*, 3*c* and 3*d*, and the toner images of respective colors formed on the photosensitive drums 3*a*, 3*b*, 3*c* and 3*d* are transferred onto a recording material P borne on and conveyed by the transfer belt 71. Further, the recording material P to which the toner images of respective colors have been transferred has the toner images thereon fixed by heating and pressurization in a fixing device 9, and thereafter is discharged out of the apparatus as a recorded image.

With regard to the image formation on the photosensitive drums, an original G is first set on an original glass stand 10 with its surface to be copied facing downward. Next, a copy button is depressed, whereby copying is started. An original illuminating lamp, a short focus lens array and a CCD sensor, not shown, as an integral unit scans the original while irradiating it, whereby the illuminating and scanning light is imaged by the short focus lens array and enters the CCD sensor. The CCD sensor is comprised of a light receiving portion, a forwarding portion and an outputting portion. In the CCD light receiving portion, a light signal is converted into a charge signal, which in turn is sequentially forwarded to the outputting portion in synchronism with a clock pulse by the forwarding portion, and in the outputting portion, the charge signal is converted into a voltage signal, which is amplified and made low in impedance and is outputted. An analog signal obtained in this manner is subjected to well-known image processing and is converted into a digital signal, which is sent to a printer station. In the printer station, in response to the above-mentioned image signal, an electrostatic latent image is formed in the following manner. The photosensitive drums 3*a*, 3*b*, 3*c* and 3*d* are rotatively driven at a predetermined peripheral speed in the direction indicated by the arrow about central support shafts, and in the rotating process thereof, they are subjected to a uniform charging process of the negative polarity by magnetic brush chargers 2*a*, 2*b*, 2*c* and 2*d* rotatively driven in the direction indicated by the arrow, and the light of a solid state laser element ON-OFF-emitted to the uniformly charged surfaces correspondingly to the image signal is scanned by a rotary polygon mirror rotated at a high speed, whereby electrostatic latent images corresponding to the image of the original are successively formed on the surfaces of the photosensitive drums.

Figure 3:
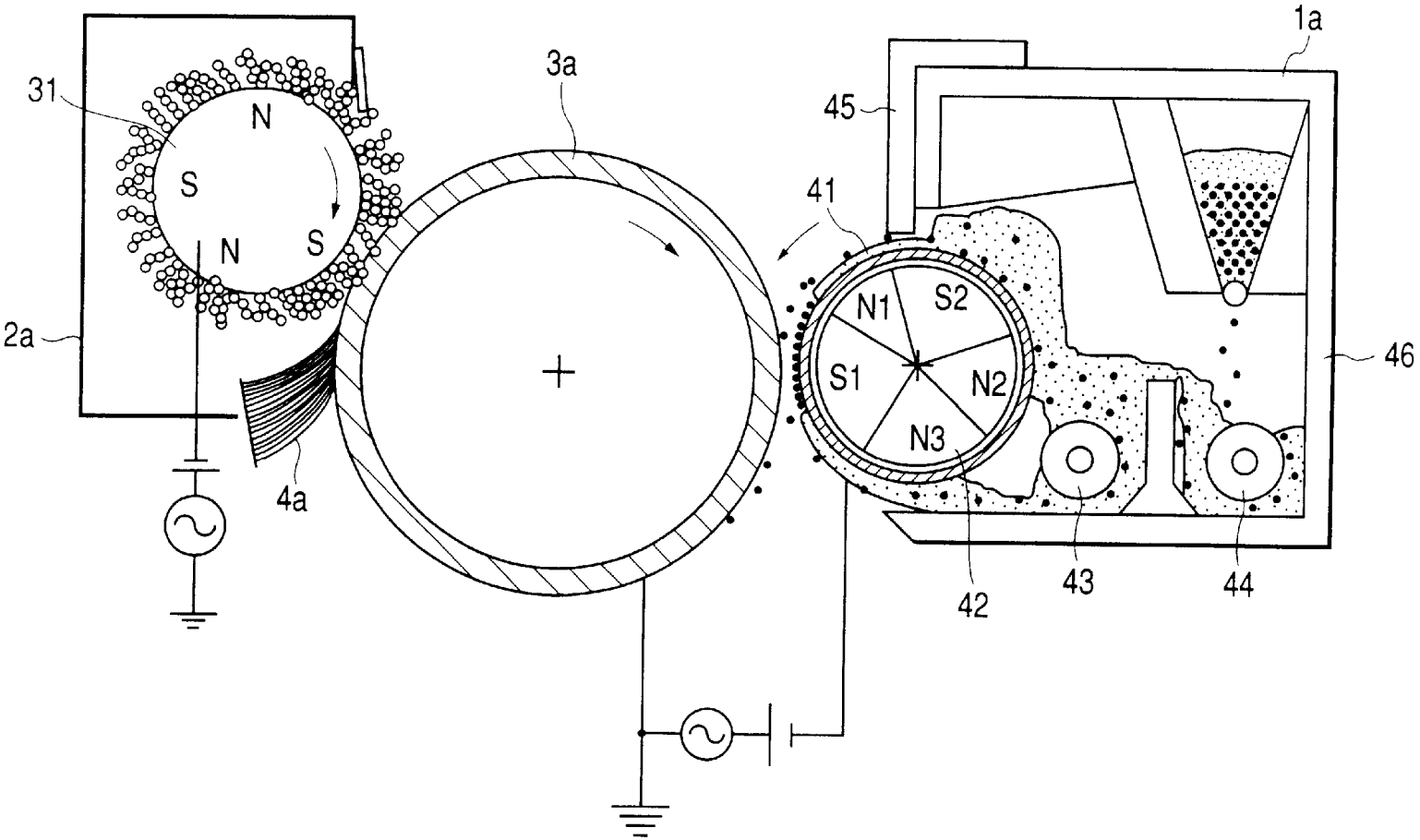
FIG. 3 is a typical cross-sectional view showing the construction around a photosensitive drum in the image forming apparatus.

The charging and developing steps around the photosensitive drums will be described in accordance with FIG. 3. The constructions of the image forming stations Pa, Pb, Pc and Pd are similar to one another and therefore, what is around the photosensitive drum 3*a* will be described herein by way of example.

As the photosensitive drum 3*a* used in the present invention, use can be made of an organic photoconductor which is usually used or the like, but desirably, if use is made of a drum having on an organic photoconductor a surface layer having a material of resistance of $10^9$–$10^{14}$ Ωcm, or an amorphous silicon photoconductor or the like, charge-injection charging can be realized, and this is effective for the prevention of the creation of ozone and the reduction in consumed electric power. Also, it becomes possible to improve chargeability. So, in the present embodiment, use is made of a photosensitive drum which is a negatively charged organic photoconductor having the following first to fifth layers provided in succession from below on a drum base body made of aluminum having a diameter of 30 mm.

The first layer is an undercoat layer which is an electrically conducting layer having a thickness of 20 μm provided to make the defect or the like of the aluminum base body even.

The second layer is a positive charge blocking layer which plays the role of preventing positive charges injected from the aluminum base body from negating negative charges charged on the surface of the photoconductor, and is a medium-resistance layer having a thickness of 1 μm resistance-adjusted to the order of $1\times10^6$ Ωcm by Amilan resin and methoxymethylated nylon.

The third layer is a charge generation layer which is a layer having a thickness of about 0.3 μm and having a diazo type pigment dispersed in resin, and generates a pair of positive and negative charges by being subjected to exposure.

The fourth layer is a charge transport layer having hydrazone dispersed in polycarbonate resin, and is a P type semiconductor. Accordingly, negative charges charged on the surface of the photoconductor cannot move through this layer, and only the positive charge generated in the charge generation layer can be transported to the surface of the photoconductor.

The fifth layer is a charge injection layer which is a coat layer of a material having ultrafine particles of $SnO_2$ dispersed in a binder of insulative resin. Specifically, it is a coat layer of a material having $SnO_2$ particles having a particle diameter of about 0.03 μm made low in resistance (made electrically conductive) with antimony which is a light-transmitting insulative filler doped on insulative resin and dispersed in the resin at 70 weight percent.

The thus prepared coating liquid was applied to a thickness of 3 μm by a suitable coating method such as the dipping coating method, the spray coating method, the roll coating method or the beam coating method to thereby obtain the charge injection layer.

In the present embodiment, a magnetic brush charging system is used as the charger.

A magnetic brush charger 2*a* used in the present embodiment is such that on a rotatable non-magnetic sleeve 31 having an outer diameter of 16 mm and having a stationary magnet provided therein, magnetic particles are formed into a brush-like shape by a magnetic field and the magnetic particles are conveyed with the rotation of the non-magnetic sleeve 31. Also, the non-magnetic sleeve 31 is rotated in a counter direction (the direction indicated by the arrow in FIG. 3) relative to the photosensitive drum 3*a*, and in the present embodiment, the magnetic brush charger is rotated at a rotational speed of 150 mm/sec. relative to the rotational speed 100 mm/sec. of the photosensitive drum 3*a*. A charging voltage is applied to the non-magnetic sleeve 31, whereby charges are given from the magnetic particles onto the photosensitive drum 3*a*, and the photosensitive drum 3*a* is charged to potential corresponding to the charging voltage. With regard to the rotational speed, there is the tendency that the higher it is, the better becomes the uniformity of charging.

Also, as regards a magnetic carrier used as a charging member, it is preferable to use one having an average particle diameter of 10–100 μm, saturated magnetization of 20–250 emu/cm$^3$ and resistance of $1\times10^2$ –$1\times10^{10}$ Ωcm, and preferably one having resistance of $1\times10^6$ Ωcm or greater when it is taken into consideration that the defect of insulation like a pinhole exists in the photosensitive drum. To make the charging performance good, it is preferable to use a magnetic carrier having the smallest possible resistance and therefore, in the present embodiment, use is made of magnetic particles having an average particle diameter of 25 $\mu$m, saturated magnetization of 200 emu/cm$^3$ and resistance of $5\times10^6$ Ωcm.

Here, the resistance value of the carrier is measured with 2g of carrier being put into a metallic cell having a bottom surface area of 228 mm$^2$, and thereafter the carrier being weighted by 6.6 kg, and a voltage of 100 V being applied thereto.

As the magnetic particles, use can be made of a resin carrier formed with magnetite as a magnetic material dispersed in resin, and carbon black dispersed for electrical conduction and resistance adjustment, or magnetite simple substance such as ferrite having had its surface subjected to oxidation and reduction process to thereby effect resistance adjustment, or magnetite simple substance such as ferrite having had its surface coated with resin to thereby effect resistance adjustment.

Also, the width of the nip formed relative to the photosensitive drum is adjusted so as to be nearly 6 mm.

A description will now be made of the amplitude of the applied bias when a rectangular AC voltage of a frequency of 1000 Hz is applied to the charger and the charging potential during the first round of the photosensitive drum. By the aforementioned amplitude being made great, the difference between the DC component of the applied bias and the charging potential during the first round becomes small. More particularly describing, when the DC component of the bias applied to the charger is defined as Vdc and the surface potential on the photosensitive drum 3*a* charged at this time is defined as Vs, if $\Delta V=|Vdc-Vs|$ which is the difference between these becomes equal to or less than about 40 V, the uniformity of charging becomes good. So, in the present embodiment, a bias comprising a rectangular AC voltage of 1000 Hz and 800 V superimposed upon a DC voltage of −700 V was applied to the charger, whereby good chargeability could be obtained.

The developing step will be described here. In FIG. 3, the reference character 1*a* designates a developing device for two-component magnetic brush development used in the present embodiment. In FIG. 3, the reference numeral 41 denotes a developing sleeve, the reference numeral 42 designates a magnet roller stationarily disposed in the developing sleeve 41, the reference numerals 43 and 44 denote agitating screws, the reference numeral 45 designates a regulating blade disposed to form a developer into a thin layer on the surface of the developing sleeve 41, and the reference numeral 46 denotes a developing container. The developing sleeve 41 is disposed so that at least during development, the most proximate area thereof to the photosensitive drum 3*a* may be about 500 $\mu$m, and is set so as to be capable of developing with the developer contacting with the photosensitive drum 3*a*.

A description will now be made of the developing step of visualizing the electrostatic latent image formed on the photosensitive drum 3*a* by the two-component magnetic brush method by the use of the above-described developing device 1*a* and of a developer circulation system. First, the developer dipped up by a pole N2 with the rotation of the developing sleeve 41 is regulated by the regulating blade 45 disposed perpendicularly to the developing sleeve 41 in the process of being carried by a pole S2→ a pole N1, and is formed into a thin layer on the developing sleeve 41. When the developer thus formed into a thin layer is carried by a pole S1 which is a main developing pole, a magnetic brush is formed by a magnetic force. The electrostatic latent image is developed by this developer which stands like the ear of rice, whereafter by the repulsive magnetic field of a pole N3 and the pole N2, the developer on the developing sleeve 41 is returned into the developing container 46.

A DC voltage and an AC voltage are applied from a voltage source, not shown, to the developing sleeve 41, and in the present embodiment, −500 V is applied as the DC voltage and Vpp=1500 V, Vf=2000 Hz is applied as the AC voltage. Generally, in the two-component developing method, when an AC voltage is applied, developing efficiency is increased and images become high in dignity, but conversely fog becomes liable to occur. Therefore, usually, a potential difference is provided between the DC voltage applied to the developing device 1*a* and the surface potential of the photosensitive drum 3*a*, whereby the prevention of fog is realized.

The developing devices 1*a*, 1*b*, 1*c* and 1*d* shown in FIG. 1 are filled with predetermined amounts of yellow, magenta, cyan and black toners, respectively, as developers by a supplying device, not shown. The developing devices 1*a*, 1*b*, 1*c* and 1*d* develop the latent images on the photosensitive drums 3*a*, 3*b*, 3*c* and 3*d*, respectively and visualize them as a yellow toner image, a magenta toner image, a cyan toner image and a black toner image.

Now, as regards the characteristics of the color toners, first as a two-component type developer, use was made of a mixture of a polymer toner made by the suspension polymerizing method and a resin magnetic carrier made by the polymerizing method. The T/D ratio of the obtained developer was 8%. As the magnetic carrier, use was made of a carrier having a magnetized amount of 100 emu/cm$^3$ in a magnetic field of 1 kilooersted, and having a number average particle diameter of 40 $\mu$m and further having specific resistance of $10^{13}$ Ωcm. Also, as the non-magnetic polymer toner, use was made of a toner having a weight average particle diameter of 8 $\mu$m and having specific gravity of 1.05 g/cm$^3$ and having an average charge amount of 25 $\mu$c/g per unit mass.

As the polymer toner used in the present invention, a substantially spherical toner of which the shape factor SF-1 is within the range of 100–140 and the shape factor SF-2 is within the range of 100–120 is preferable for maintaining high transfer efficiency. In the present invention, one hundred toner particles were sampled at random by the use of a scanning type electronic microscope FE-SEM (S-800) produced by Hitachi, Ltd., and the image information thereof was introduced into an image analyzing apparatus (Luzex 3) produced by Nicolet Japan Corporation through an interface and analysis was carried out, and values obtained by calculating from the following expressions were defined as the shape factors SF-1 and SF-2.

$$SF-1=\frac{(MXLNG)^2}{AREA}\times\frac{4}{\pi}\times100$$

$$SF-2=\frac{(PERI)^2}{AREA}\times\frac{1}{4\pi}\times100$$

(AREA: toner projection area;

MXLNG: absolute maximum length;

PERI: peripheral length)

By using such a spherical toner, it becomes possible to always secure transfer efficiency of 95% or greater, and this is a constituent element effective for a cleaningless system.

These toner images are then transferred to a recording material P by a transfer device 7. As shown in FIG. 1, the transfer device 7 comprises an endless transfer belt 71 as a recording material bearing member passed over a driving roller 72 and a driven roller 73, and rotated in the direction indicated by the arrow in FIG. 1. Further, the transfer device 7 is provided with transfer charging blades 6*a*, 6*b*, 6*c* and 6*d* therein, and the transfer charging blades 6*a*, 6*b*, 6*c* and 6*d* generate pressure forces from the inside of the transfer belt 71 toward the photosensitive drums 3*a*, 3*b*, 3*c* and 3*d*, and are supplied with electric power from a high voltage source to thereby effect charging opposite in polarity to the toners from the back side of the recording material P, thereby successively transferring the toner images on the photosensitive drums 3*a*, 3*b*, 3*c* and 3*d* to the upper surface of the recording material P.

The recording material P is sequentially conveyed from a sheet feeding and conveying device to respective transfer positions provided by the photosensitive drums 3*a*, 3*b*, 3*c* and 3*d* and the transfer belt 71, with proper timing in synchronism with the rotation of the photosensitive drums 3*a*, 3*b*, 3*c* and 3*d*. In the present embodiment, the transfer belt 71 comprises a sheet formed of dielectric material resin having an electrically conductive filler such as carbon black dispersed therein and subjected to resistance adjustment, and in the present embodiment, use is made of a sheet formed of polyimide resin having volume resistivity of $10^{12}$ Ωcm and a film thickness of 75 μm, and having its opposite end portions superposed one upon the other and joined together so as to assume an endless shape, or a belt having no seam (seamless).

Also, the transfer belt 71 used as the recording material bearing member is a belt of such physical property values that the abrasion wear of the surface thereof in the operation of the actual apparatus is equal to or greater than 0.01 μm and equal to or less than 1.0 μm per 10,000 revolutions. Specifically, when as the transfer belt 71 in the present embodiment, use was made of a belt of such physical property values as tensile strength 3,200 kgf/cm$^2$, Young's modulus $6.0\times10^4$ kgf/cm$^2$, and JIS ten-point-average surface roughness Rz 0.92 μm (a surface roughness measuring machine produced by Kosaka Laboratory Ltd., length 0.8, cutoff 0.08), the abrasion wear on the actual apparatus was 0.05 μm/10,000 revolutions.

Further, as the transfer charging blades 6*a*, 6*b*, 6*c* and 6*d*, use is made of blades having resistance of $1\times10^5$–$1\times10^7$ Ω, a plate thickness of 2 mm and a length of 306 mm. Transfer is effected with a bias of +15 μA applied to these transfer charging blades 6*a*, 6*b*, 6*c* and 6*d* by constant current control.

In this manner, the toner images formed on the photosensitive drums 3*a*, 3*b*, 3*c* and 3*d* are electrostatically transferred onto the recording material by the transfer charging blades 6*a*, 6*b*, 6*c* and 6*d*, respectively.

As described above, image formation and transfer in the first to fourth image forming stations Pa–Pd are sequentially effected in a similar manner.

The recording material P is supplied from a feed tray 17, is supplied to the transfer belt 71 via a conveying roller and registration rollers 12, and is sequentially fed to the transfer positions opposed to the photosensitive drums 3*a*, 3*b*, 3*c* and 3*d* by the conveyance by the transfer belt 71.

The transfer belt 71 is rotated by the driving roller 72 and when it reaches a predetermined speed, the recording material P is fed out from the registration rollers 12 to the transfer belt 71, and the recording material P is conveyed toward the transfer positions. At the same time, an image writing-out signal becomes ON and with it as the reference, image formation is effected on the respective photosensitive drums at predetermined timing. The transfer charging blades 6*a*, 6*b*, 6*c* and 6*d* induce electric fields or charges at the transfer positions under the respective photosensitive drums 3*a*, 3*b*, 3*c* and 3*d*, whereby the toner images formed on the photosensitive drums 3*a*, 3*b*, 3*c* and 3*d* are transferred to the recording material P. The recording material P, before the transfer, is electrostatically attracted to and held on the transfer belt 71 by an attracting charger 11*a* and an attracting charger opposite roller 11*b*, and is conveyed toward a fixing device 9.

The attracting charger 11*a* uses a charging roller with a view to stabilize the close contact between the recording material P and the transfer belt 71 simultaneously with the charging.

Next, the recording material P to which the toner images have been transferred has its charges eliminated by a separating charger 16 in the downstream portion of the transfer belt 71 with respect to the direction of conveyance and has its electrostatic attraction attenuated, whereby it leaves the distal end of the transfer belt 71. Particularly in a low humidity environment, the recording material also becomes dry and its electrical resistance becomes high and therefore, the electrostatic attraction between it and the transfer belt 71 becomes great, and the effect of the separating charger 16 becomes great. As the separating charger 16, use is made of a non-contact charger because the recording material P has its charges eliminated in a state in which the toner images thereon are unfixed. As the output of the separating charger 16, use is made of an AC voltage of the order of Vp–p=10 kV and 500 Hz. Also, in order to prevent bad images such as the scattering of the toners, a plus or minus DC component of the order of 100 μA is superimposed on the aforementioned AC output.

The recording material P having left the distal end of the transfer belt 71 is conveyed to the fixing device 9. The fixing device 9 is comprised of a fixing roller 51, a pressure roller 52, a heat-resisting cleaning member for cleaning each of them, and a thermistor for detecting the surface temperature of a heater installed in each roller and controlling the fixing temperature. The recording material P having the toner images formed thereon is subjected to the fixing of the toner images thereon to thereby form a full color copy image, and is discharged onto a discharge tray 18.

In FIG. 1, the reference characters 4*a*, 4*b*, 4*c* and 4*d* designate fur brushes made of rayon for rendering untransferred toners in which the positive and negative polarities coexist into the positive polarity to thereby make it easy for magnetic brush chargers 2*a*, 2*b*, 2*c* and 2*d* to collect the untransferred toners, and a bias applied thereto is +500 V.

As regards the transfer belt 71 after the recording material P has been separated therefrom, an electrically conductive fur brush 8 grounded to the recording material bearing side and the driving roller 72 grounded in opposed relationship with the electrically conductive fur brush 8 are brought into contact with the transfer belt 71 to thereby remove the toners and other foreign substances residual on the transfer belt 71 and eliminate accumulated charges. Further, the residual toners on the transfer belt 71 are wiped off with a cleaning blade 5 made to abut against the surface of the transfer belt 71.

The cleaning blade 5 constituting the cleaning .means for the transfer belt 71 is constituted by a blade having a length of 315 mm in a longitudinal direction of the blade, rubber hardness of 77° (JIS A), modulus of repulsion elasticity (JIS-K6255) 45% (at the point of time of 23° C.) [blade temperature/modulus of repulsion elasticity=23/45=0.51], a plate thickness of 2 mm and a free length 8 mm. As a cleaning unit having this cleaning blade 5, as shown in FIG.

2, a holding member 5*a* holding the cleaning blade 5 is swingable about a rotary shaft 55. A spring 5*c* which is biasing means is provided on one end portion of the holding member 5*a*, and biases the cleaning blade 5 toward the transfer belt 71. Design is made such that the swinging fulcrum angle θ formed by a tangential line 5*e* passing through the abutting portion 5*d* of the cleaning blade 5 against the transfer belt 71 with a straight line 5*f* connecting the abutting portion 5*d* and the center of the rotary shaft 55 together is equal to or greater than 0° and equal to or smaller than 15°. In the present embodiment, the cleaning unit is constructed with a swinging fulcrum angle of 0°, a blade abutting angle (the angle formed by the tangential line 5*e* with the blade) of 25°, and the total pressure 1.5 kgf of the blade abutting against the transfer belt 71 (the abutting pressure force per unit length in the longitudinal direction of the blade is 1500/31.5=47.6 gf/cm).

As in the above-described construction, the cleaning blade 5 is swingably constructed so as to be biased toward and abut against the transfer belt 71, whereby as compared with the case of a blade fixing method, it becomes possible to minimize a change in the abutting pressure of the blade which is fluctuated by the fluctuations of part tolerance, assembly tolerance and the fluctuation between respective members during the operation thereof. Thereby, even when the frictional force of the transfer belt becomes high due to the stain or the like of the surface of the transfer belt, it becomes possible to suppress the arising of such problems as the wire edge or edge breakage of the blade and increased driving torque due to excessive abutting pressure caused by the above-mentioned tolerances, and bad cleaning due to the deficiency of the abutting pressure.

Also, the range of the swinging fulcrum angle e is below 0°. That is, when the position of the rotary shaft 55 is more adjacent to the transfer belt 71 than the tangential line 5*e* in FIG. 2, the blade comes to assume a position in which it is liable to escape by a force it receives from the movement of the transfer belt 71, and the sufficient abutting of the blade cannot be effected. When the swinging fulcrum angle is not less than 0° and not less than 15°, the blade comes to embed itself into the transfer belt side by the force it receives from the direction of movement of the transfer belt 71, and coupled with the action of the biasing spring 5*c*, it can secure an appropriate abutting state. When the swinging fulcrum angle exceeds 15°, the abutting pressure of the blade becomes too high and there may arise such problems as blade turning-up, edge breakage and an increase in driving torque.

As shown in FIG. 4, in the first embodiment, even if in the construction as described above, the coefficient of dynamic friction of the transfer belt 71 formed of polyimide (PI) changed from its initial value 0.3 to 0.6 after endurance, the reversal of the cleaning blade due to an increase in the load of the transfer belt and bad images such as color misregister due to the great load of the transfer belt motor did not occur. As the result of an image output endurance test, no inconvenience actualized in images was seen in the above-described transfer belt for a long period of 1,000,000 sheets and in the cleaning blade for a long period of 500,000 sheets, and images of good quality were stably maintained.

[Second Embodiment]

An image forming apparatus according to a second embodiment will now be described briefly. In the present embodiment, the other members than the transfer belt are similar in construction to those in the aforedescribed first embodiment and therefore need not be described in detail. The transfer belt 71 used in the present embodiment has such physical property values as tensile strength 4000 kgf /cm$^2$, Young's modulus 7.0×10$^4$ kgf/cm$^2$, surface roughness Rz 0.52 μm (produced by Kosaka Laboratory Ltd., length 0.8, cutoff 0.08) and coefficient of initial dynamic friction 0.20 (HEIDON, Tribogear Muse TYPE: 94 B).

As shown in FIG. 4, in the second embodiment, in the construction as described above, the abrasion wear of the surface of the transfer belt in the actual apparatus was 0.3 μm/10000 revolutions. As the result of an image output endurance test, no inconvenience actualized in images was seen in the transfer belt for a long period of 1,000,000 sheets and in the cleaning blade for a long period of 500,000 sheets, and images of good quality were stably maintained.

[Third Embodiment]

An image forming apparatus according to a third embodiment will now be described briefly. In the present embodiment, except for the swinging fulcrum angle and modulus of repulsion elasticity/hardness of the cleaning blade which is a cleaning member for the transfer belt, the construction is similar to that of the first embodiment and need not be described in detail. In the present embodiment, the cleaning blade 5 constituting the cleaning means for the transfer belt 71 is constructed with a swinging fulcrum angle of 10°, rubber hardness of 70° (JIS A) and modulus of repulsion elasticity of 30% (23° C.) [blade temperature/modulus of repulsion elasticity=23/30=0.77].

As shown in FIG. 4, in the third embodiment, in the construction as described above, the abrasion wear of the surface of the transfer belt in the actual apparatus was 0.05 μm/10,000 revolutions. Also, even if the coefficient of dynamic friction of the transfer belt 71 changed from its initial value 0.3 to 0.5 after endurance, the reversal of the cleaning blade due to an increase in the load of the transfer belt and such a bad image as the color misregister due to the great load of the transfer belt motor did not occur. As the result of an image output endurance test, no inconvenience actualized in images was seen in the transfer belt for a long period of 1,000,000 sheets and in the cleaning blade for a long period of 500,000 sheets, and images of good quality were stably maintained.

[Comparative Examples]

Three comparative examples to the above-described embodiments of the present invention will be exemplified below.

An image forming apparatus according to Comparative Example 1 will first be described briefly. In Comparative Example 1, except for the swinging fulcrum angle of the cleaning blade for the transfer belt, the construction is similar to that of the aforedescribed first embodiment and therefore need not be described in detail. In Comparative Example 1, the cleaning blade for the transfer belt is constructed with a swinging fulcrum angle of 30°.

As shown in FIG. 4, in Comparative Example 1, when in the construction as described above, the coefficient of dynamic friction of the transfer belt became 0.5, the abutting pressure became excessively great, and during continuous sheet supply, the reversal (turning-up) of the cleaning blade occurred.

An image forming apparatus according to Comparative Example 2 will now be described briefly. In Comparative Example 2, except for the swinging fulcrum angle of the cleaning blade for the transfer belt, the construction is similar to that of the aforedescribed first embodiment and therefore need not be described in detail. In Comparative Example 2, the cleaning blade for the transfer belt is constructed with a swinging fulcrum angle of −15°.

As shown in FIG. 4, in Comparative Example 2, in the construction as described above, bad cleaning due to the insufficient abutting of the blade occurred at the starting after the supply of about 50,000 sheets.

An image forming apparatus according to Comparative Example 3 will now be described briefly. In Comparative Example 3, except for the transfer belt, the construction is similar to that of the aforedescribed first embodiment and therefore need not be described in detail. The transfer belt used in Comparative Example 3 uses polycarbonate (PC) and has such physical property values as tensile strength 660 kgf/cm$^2$, Young's modulus $2.0\times10^4$ kgf/cm$^2$ and surface roughness Rz 0.60 $\mu$m (produced by Kosaka Laboratory Ltd., length 0.8, cutoff 0.08).

As shown in FIG. 4, in Comparative Example 3, in the construction as described above, the abrasion wear of the transfer belt in the actual apparatus was as excessively great as 2.0 $\mu$m/10,000 revolutions. As the result of an image output endurance test carried out after the supply of 100,000 sheets, the roughness of the transfer belt was as great as Rz 4,50 $\mu$m (produced by Kosaka Laboratory Ltd., length 0.8, cutoff 0.08), and streaky bad images occurred.

[Fourth Embodiment]

Figure 5:
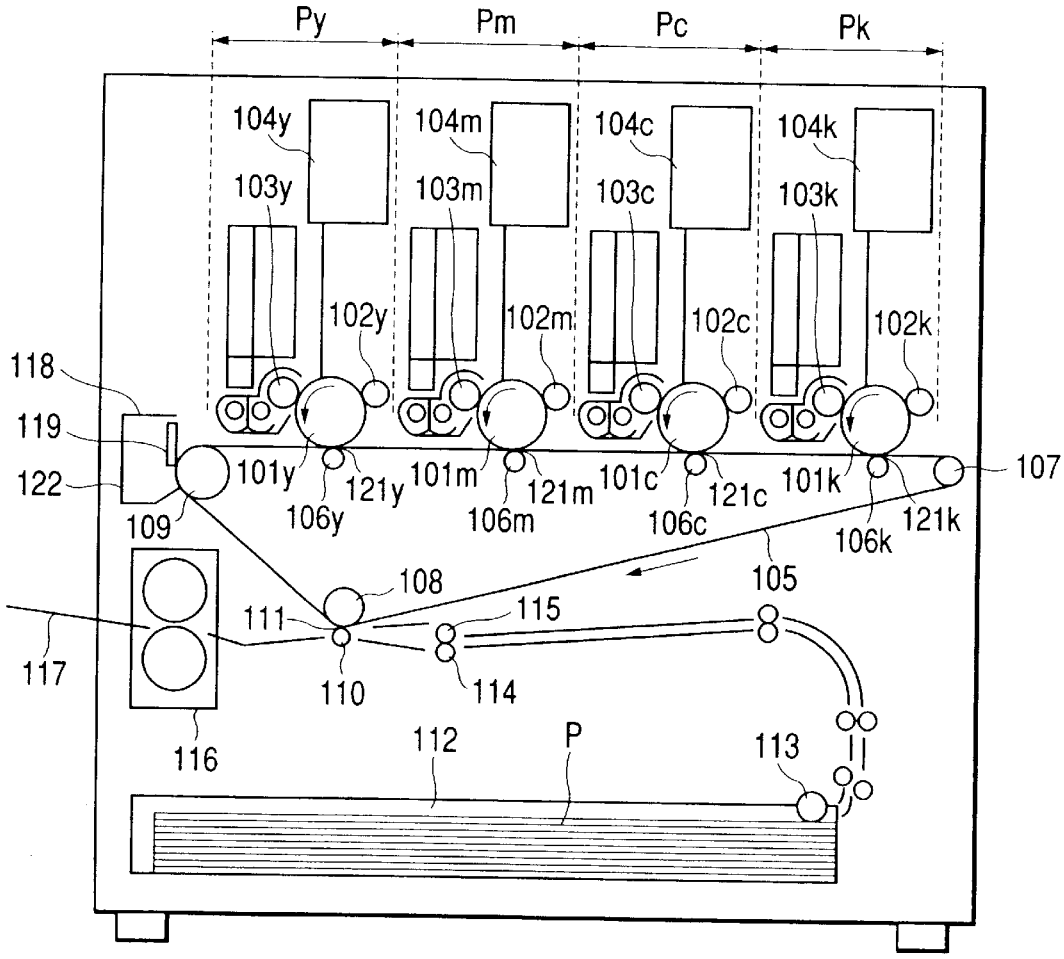
FIG. 5 schematically shows the construction of an embodiment of the image forming apparatus of the present invention.
Figure 6:
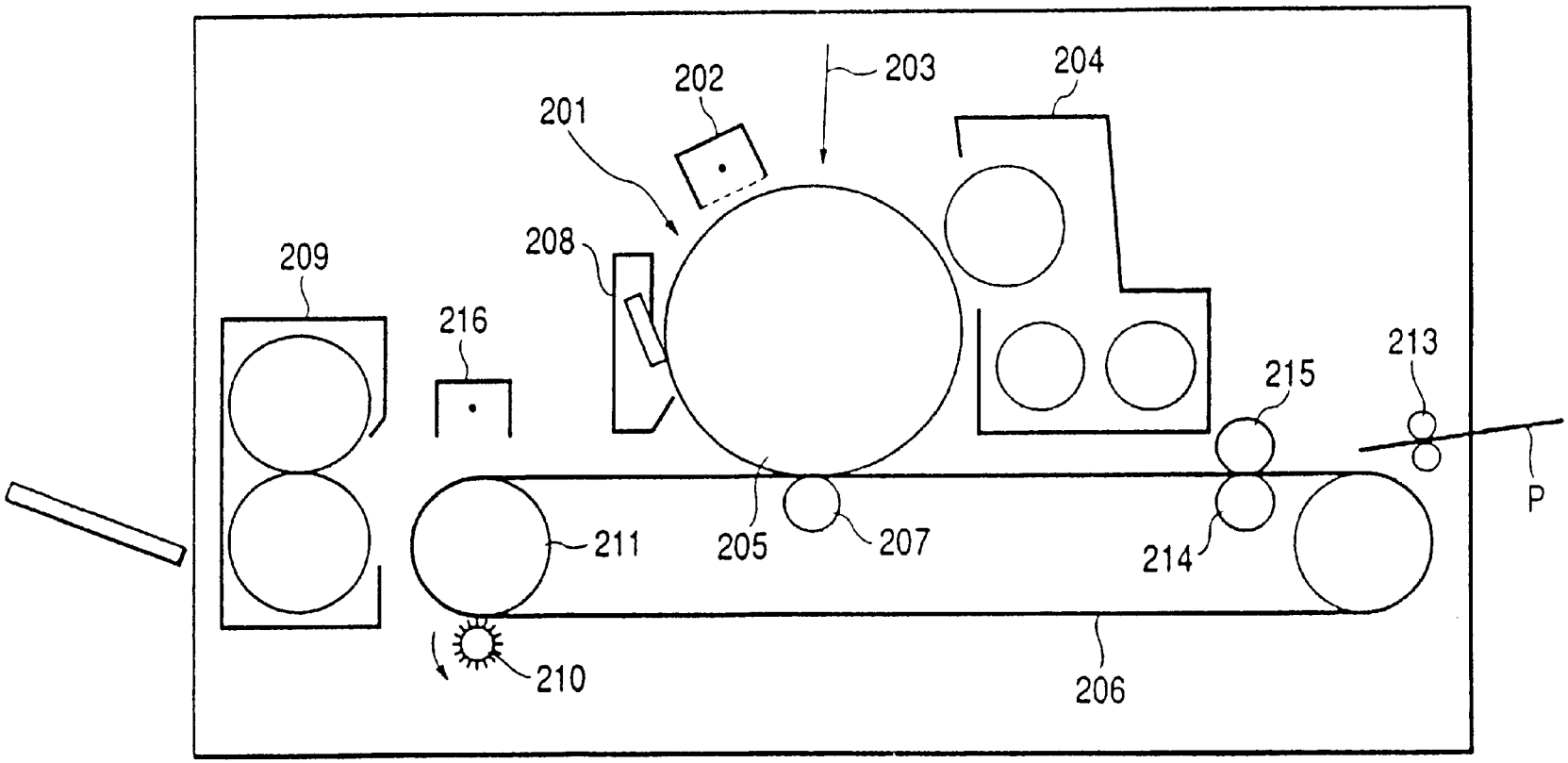
FIG. 6 PRIOR ART
FIG. 6 is a cross-sectional view of an image forming apparatus according to the conventional art.

FIG. 5 schematically shows the construction of an embodiment of the image forming apparatus of the present invention. The cleaning device described in the above-described embodiments can also be used for an intermediate transfer belt used in the following image forming apparatus to obtain a similar effect.

As shown in FIG. 5, the present image forming apparatus has a plurality of image forming units Py, Pm, Pc and Pk, which are arranged in the named order along the direction of movement of an intermediate transfer belt 105 which is a bearing and conveying member on the upper track of the intermediate transfer belt 105.

The image forming units Py, Pm, Pc and Pk have photosensitive drums 101*y*, 101*m*, 101*c* and 101*k*, respectively, and the formation of yellow, magenta, cyan and black images of the negative charging polarity as the color resolved component images of a full color image is done. In the present embodiment, each of these photosensitive drums 101y–101k is an organic photoconductor (OPC) having a diameter of 30 mm and a length of 300 mm, and is rotatively driven at a peripheral speed (process speed) of 100 mm/sec. in the counter-clockwise direction indicated by the arrow.

Around the photosensitive drums 101*y*, 101*m*, 101*c* and 101*k*, there are disposed primary chargers 102*y*, 102*m*, 102*c* and 102*k*, image exposing devices 104*y*, 104*m*, 104*c* and 104*k*, developing devices 103*y*, 103*m*, 103*c* and 103*k*, and primary transfer rollers 106*y*, 106*m*, 106*c* and 106*k*.

In the present embodiment, each of the primary chargers 102*y*–102*k* comprise a scorotron type corona charger. To form images, the photosensitive drums 101*y*–101*k* are rotated and in this rotating process, the surfaces of the photosensitive drums 101*y*–101*k* are first uniformly charged by the primary chargers 102*y*–102*k*. In the present embodiment, the surfaces of the photosensitive drums 101*y*–101*k* were uniformly charged to nearly −700 V.

The image exposing devices 104*y*–104*k* use LED arrays as solid state scanners which do not require optical path lengths and are advantageous for the downsizing of the apparatus. The individual LED's of these LED arrays 104*y*–104*k* are ON/OFF-controlled correspondingly to the time-series electrical digital pixel signal of original image information inputted from an image reading apparatus, not shown, whereby image exposure is done on the uniformly charged surfaces of the photosensitive drums 110*y*–101*k*, and the surface potential of the exposed portions of the photosensitive drums 110*y*–101*k* decays and electrostatic latent images are formed.

In the present embodiment, the developing devices 103*y*–103*k* as developing means comprise two-component magnetic brush developing devices. Each of the developing devices 103*y*–103*k* has, in a developing container containing therein a two-component developer which is a mixture of a non-magnetic toner and a magnetic carrier, a developing sleeve, a magnet roller stationarily disposed in the developing sleeve, and a regulating blade for applying the developer as a thin layer to the surface of the developing sleeve.

The developing device 103*y* in the image forming unit Py for yellow contains therein a two-component developer containing a yellow toner, and reversal-develops the electrostatic latent image corresponding to a yellow image which is formed on the surface of the photosensitive drum 101*y*, and visualizes it as a yellow toner image. The developing devices 103*m*, 103*c* and 103*k* in the image forming units Pm, Pc and Pk for the other colors also apply correspondingly thereto, and reversal-develop the respective electrostatic latent images by a similar method and visualize them as magenta, cyan and black toner images.

The intermediate transfer belt 105 is an endless belt as an intermediate transfer member, and is passed over three rollers, i.e., a driving roller 107, a secondary transfer opposite roller 108 and a driven roller 109. This intermediate transfer belt 105 is disposed over the range of the image forming units Py–Pk in such a manner as to contact with the lower surfaces of the photosensitive drums 110*y*–101*k*, and is rotatively driven in the clockwise direction indicated by the arrow at the same peripheral speed as that of the photosensitive drums 110*y*–101*k*.

The primary transfer rollers 106*y*–106k are disposed inside the belt portion of the upper track of the intermediate transfer belt 105 in opposed relationship with the respective photosensitive drums 110*y*–101*k*. The primary transfer roller 106*y* of the image forming unit Py for yellow is in contact with the lower surface of the photosensitive drum 101*y* with the intermediate transfer belt 105 interposed therebetween to thereby form a primary transfer position 121*y*. Likewise, the primary transfer rollers 106*m*, 106*c* and 106*k* of the image forming units Pm, Pc and Pk for magenta, cyan and black are in contact with the lower surfaces of the photosensitive drums 101*m*, 110*c* and 101*k*, respectively, with the intermediate transfer belt 105 interposed therebetween to thereby form primary transfer positions 121*m*, 121*c* and 121*k*.

A transfer bias opposite in polarity to the toners is applied from a primary transfer power source, not shown, to the respective primary transfer rollers 106*y*–106*k*, and by the application of this transfer bias, the toner images on the photosensitive drums 101*y*–101*k* are superimposed and electrostatically primary-transferred onto the surface of the intermediate transfer belt 105 the respective primary transfer positions 121*y*–121*k*. Thereby, a full color image comprising yellow, magenta, cyan and black toner images superimposed one upon another and combined together is formed on the intermediate transfer belt 105.

According to the present invention, the image forming apparatus adopts a system of cleaning simultaneous with developing and exists as a cleanerless system, and the developing devices 103*y*–103*k* serve also as cleaning means for removing untransferred toners residual after the toner images on the respective photosensitive drums 110*y*–101*k* have been transferred. Accordingly, the image forming units Py–Pk are not provided with dedicated cleaning devices for the photosensitive drums 110*y*–101*k*. However, developing need not be effected simultaneously with cleaning.

At the location of the secondary transfer opposite roller 108 of the intermediate transfer belt 105, there is disposed a secondary transfer roller 110 which is in contact therewith with the intermediate transfer belt 105 interposed therebetween to thereby form a secondary transfer position 111. The full color image formed on the intermediate transfer belt 105 comes to the secondary transfer position 111 with the rotation of the intermediate transfer belt 105, and a transfer bias opposite in polarity to the toners is applied from a secondary transfer power source, not shown, to the secondary transfer roller 110, whereby the full color image is collectively secondary-transferred to the surface of a recording material (recording paper) P supplied to the secondary transfer position.

The recording material P is contained in a feed cassette 112 disposed in the lower portion of the image forming apparatus. The recording material P in the cassette 112 is taken out and conveyed by a feed roller 113, and is once stopped by a pair of registration rollers 114 and 115 short of the secondary transfer position 111, whereafter the recording material P is supplied to the secondary transfer position 111 in timed relationship with the arrival of the leading end of the image on the intermediate transfer belt 105 at the secondary transfer position 111.

The recording material P to which the full color image has been transferred at the secondary transfer position 111 is separated from the surface of the intermediate transfer belt 105 and is introduced into a fixing device 116, where the recording material P is subjected to the heat fixing of the image, whereby the image on the recording material P is made into a permanent full color image, and the recording material P is discharged onto a tray 117 outside the apparatus.

After the completion of the secondary transfer, the intermediate transfer belt 105 has the untransferred toners residual on the surface thereof during the secondary transfer and paper dust adhering thereto from the recording material P removed by a belt cleaning device 118 installed at the location of the driven roller 109. This belt cleaning device 118 is made similar in construction to that in the aforedescribed first embodiment.

In the present invention, the image forming apparatus is designed such that the full color image on the intermediate transfer belt 105 is formed by the use of a plurality of photosensitive drums while the intermediate transfer belt 105 makes one full rotation. Accordingly, in the case of an image forming apparatus in which a single photosensitive drum is used to form a full color image by an intermediate transfer member being rotated a plurality of times, it has been necessary for a cleaning device for the intermediate transfer member to be separated from the intermediate transfer member when toner images are being superimposed on the intermediate transfer member, but in the present invention, it is not necessary for the belt cleaning device 118 to be moved toward and away from the intermediate transfer member, and a cleaning blade 119 can be made to abut against the intermediate transfer belt 105 at all times.

According to the present embodiment, as previously described, organic photoconductors (OPC) are used as the photosensitive drums 101*y*–101*k*, and each of these photosensitive drums comprises an aluminum base body as an electrically conductive base body and an OPC photosensitive layer formed on the peripheral surface thereof, and the OPC photosensitive layer is comprised of the following four layers laminated successively.

The first layer is an undercoat layer which is an electrically conducting layer having a thickness of 20 $\mu$m provided to make the defect or the like of the aluminum base body even.

The second layer is a positive charge blocking layer which plays the role of preventing positive charges injected from the aluminum base body from negating negative charges charged on the surface of the photoconductor, and is a medium-resistance layer having a thickness of 1 $\mu$m resistance-adjusted to the order of $1\times10^6$ Ωcm by Amilan resin and methoxymethylated nylon.

The third layer is a charge generation layer which is a layer having a thickness of about 0.3 $\mu$m and having a diazo type pigment dispersed in resin, and generates a pair of positive and negative charges by being subjected to exposure.

The fourth layer is a charge transport layer comprising a P type semiconductor having hydrazone dispersed in polycarbonate resin. Accordingly, negative charges charged on the surface of the photoconductor cannot move through this layer, and only the positive charge generated in the charge generation layer can be transported to the surface of the photoconductor.

The intermediate transfer belt 105 may use as the belt material a material having electrically conductive carbon particles, metal powder or the like dispersed in and mixed with, for example, polyurethane type resin, polyester type resin, polyethylene type resin, polyolefin type resin, polyamide type resin, polyimide type resin, polyvinyl chloride type resin, fluorine type resin or the like.

In the present embodiment, a material using carbon particles in polyimide type resin is used for the intermediate transfer belt 105. The volume resistivity thereof may preferably be within the range of $10^6$–$10^{14}$ Ωcm. If the volume resistivity of the intermediate transfer belt 105 is less than $10^6$ Ωcm, there will arise the problem that spread and thickening occur to images and transfer efficiency changes during the formation of an image having a different coverage ratio, and in the case of an intermediate transfer belt 105 having volume resistivity greater than $10^{14}$ Ωcm, there occurs abnormal discharge between the intermediate transfer belt 105 and the photosensitive drums 101*y*–101*k* or the recording material P due to the fact that the potential of the intermediate transfer belt 105 becomes too great during the transfer of the toners, and bad images occur. In the present embodiment, a seamless belt having a thickness of 100 $\mu$m and volume resistivity of $10^{11}$ Ωcm is used as the intermediate transfer belt 105.

The belt cleaning device 118, as previously described, is provided with the cleaning blade 119 which is a plate-like rubber blade, and is further comprised of a conveying screw or the like for transporting waste toners and paper dust to a container 122 for containing waste toners and paper dust therein or a waste toner container of a large capacity provided at a discrete location. Polyurethane rubber is used as the cleaning blade 119, and of the physical properties of this rubber, the tensile stress (JIS-K6301) during 5% elongation was 80–120 kgf/cm$^2$. The tensile stress was measured by cutting the rubber plate forming the cleaning blade into the shape of a dumbbell and pulling the opposite ends thereof.

If the tensile stress of the rubber of the cleaning blade 119 is less than 80 kgf/cm$^2$, even if the pressure force of the blade 119 against the intermediate transfer belt 105 is made great, pressure obtained as the peak value does not become great easily, and if an attempt is made to obtain sufficient cleaning performance for the untransferred toners and paper dust on the intermediate transfer belt 105, it becomes necessary to apply excessively great pressure, and the service lives of the blade 119 and the intermediate transfer belt 105 are shortened or the turning-up of the blade 119 occurs.

When the tensile stress of the rubber of the blade 119 is greater than 120 kgf/cm$^2$, repulsion elasticity also becomes great at the same time, whereby the vibration in the abutting portion of the blade 119 against the intermediate transfer belt 105 becomes great, and bad cleaning and the turning-up of the blade become liable to occur. Also, the permanent distortion of the blade tends to become great and therefore, a problem also arises in respect of durability.

In the image forming apparatus of the above-described construction, as the result of an image output endurance test carried out by the use of the cleaning device construction of the aforedescribed first embodiment, no inconvenience actualized in images was seen in the intermediate transfer belt for a long period of 1,000,000 sheets and the cleaning blade for a long period of 500,000 sheets, and images of good quality were stably maintained.

[Fifth Embodiment]

Another embodiment of the present invention will now be described. This embodiment is similar in basic construction to the aforedescribed first embodiment.

The cleaning blade 5 constituting the cleaning means for the transfer belt 71 is constructed with a length of 315 mm in a longitudinal direction, rubber hardness of 77° (JIS A), modulus of repulsion elasticity (JIS-K6255) of 45% (23° C.) [blade temperature/modulus of repulsion elasticity=23/45=0.51], a plate thickness of 2 mm and a free length of 8 mm. The cleaning unit is constructed with a swinging angle of 0°, an abutting angle of 25° and total pressure force of 1.5 kgf against the transfer belt 71 (pressure force of 1500/31.5=47.6 gf/cm per unit length in the longitudinal direction of the blade).

As shown in FIG. 7, in the fifth embodiment, the transfer belt 71 used in the construction as described above has such physical property values as tensile strength 3200 kgf/cm$^2$, Young's modulus $6.0\times10^4$ kgf/cm$^2$, initial surface roughness Rz 0.92 $\mu$m (produced by Kosaka Laboratory Ltd., length 0.8, cutoff 0.08) and initial coefficient of dynamic friction 0.3 (HEIDON, Tribogear Muse TYPE: 94 B). The average value of the surface roughness of this transfer belt 71 at any ten points after 10,000 revolutions (in the case of the present image forming apparatus, after the supply of 1,000,000 sheets) was Rz 1.03 $\mu$m. By the use of such a member of high strength, a low friction material and predetermined surface roughness, the abrasion wear (0.05 $\mu$m/10,000 revolutions) of the transfer belt 71 was prevented to the utmost, and bad cleaning and the reversal of the cleaning blade were not caused and bad images did not occur. As the result of an image output endurance test, no inconvenience actualized in images was seen in the above-described transfer belt for a long period of 1,000,000 sheets and in the cleaning blade for a long period of 500,000 sheets, and images of good quality were stably maintained.

[Sixth Embodiment]

An image forming apparatus according to a sixth embodiment will now be described briefly. In this embodiment, except for the transfer belt, the construction is similar to that of the fifth embodiment and therefore need not be described in detail. The transfer belt 71 used in the present embodiment has such physical property values as tensile strength 1500 kgf/cm$^2$, Young's modulus $3.2\times10^4$ kgf/cm$^2$ and surface roughness Rz 0.32 $\mu$m (produced by Kosaka Laboratory Ltd., length 0.8, cutoff 0.08). The average value of the surface roughness of this transfer belt 71 at any ten points after 10,000 revolutions (after the supply of 1,000,000 sheets) was Rz 0.41 $\mu$m.

As shown in FIG. 7, in the sixth embodiment, in the construction as described above, the abrasion wear of the transfer belt in the actual apparatus was 0.3 $\mu$m/10,000 revolutions. As the result of an image output endurance test, no inconvenience actualized in images was seen in the transfer belt for a long period of 1,000,000 sheets and in the cleaning blade for a long period of 500,000 sheets and images of good quality were stably maintained.

[Seventh Embodiment]

An image forming apparatus according to a seventh embodiment will now be described briefly. In this embodiment, except for the cleaning blade which is a cleaning member for the transfer belt, the construction is similar to that of the aforedescribed fifth embodiment and therefore need not be described in detail. In the present embodiment, the cleaning blade 5 constituting the cleaning means for the transfer belt 71 is constructed with a length of 315 mm in a longitudinal direction, rubber hardness of 70° (JIS A), modulus of repulsion elasticity of 30% (23° C.) [blade temperature/modulus of repulsion elasticity=23/30=0.77], a plate thickness of 2 mm and a free length of 8 mm. The cleaning unit is constructed with a swinging angle of 10°, an abutting angle of 20° and total pressure force of 1.7 kgf against the transfer belt 71 (abutting pressure of force 1700/31.5=54.0 gf/cm per unit length of the blade).

As shown in FIG. 7, in the seventh embodiment, in the construction as described above, the abrasion wear of the surface of the transfer belt in the actual apparatus was 0.05 $\mu$m/10,000 revolutions. The average value of the surface roughness of this transfer belt 71 at any ten points after 10,000 revolutions (in the case of the present image forming apparatus, after the supply of 1,000,000 sheets) was Rz 0.78 $\mu$m. As the result of an image output endurance test, no inconvenience actualized in images was seen in the transfer belt for a long period of 1,000,000 sheets and in the cleaning blade for a long period of 500,000 sheets and images of good quality were stably maintained.

[Comparative Examples]

Three comparative examples with the above-described embodiments of the present invention will be exemplified below.

An image forming apparatus according to Comparative Example 5 will first be described briefly. In Comparative Example 5, except for the transfer belt, the construction is similar to that of the aforedescribed fifth embodiment and therefore need not be described in detail. The transfer belt used in Comparative Example 5 uses polycarbonate and has such physical property values as tensile strength 660 kgf/cm$^2$, Young's modulus $2.0\times10^4$ kgf/cm$^2$ and surface roughness Rz 0.60 $\mu$m (produced by Kosaka Laboratory Ltd., length 0.8, cutoff 0.08).

As shown in FIG. 7, in Comparative Example 5, in the construction as described above, the abrasion wear of the transfer belt in the actual apparatus was 2.0 $\mu$m/10,000 revolutions. An image output endurance test was carried out after the supply of 100,000 sheets with a result that the surface roughness of the transfer belt reached Rz 4.50 $\mu$m (produced by Kosaka Laboratory Ltd., length 0.8, cutoff 0.08) and streaky bad images were created.

An image forming apparatus according to Comparative Example 6 will now be described briefly. In Comparative Example 6, except for the cleaning blade constituting the cleaning means for the transfer belt, the construction is similar to that of the aforedescribed first embodiment and therefore need not be described in detail. In Comparative Example 6, the cleaning blade constituting the cleaning means for the transfer belt 71 is constructed with a length of 315 mm in a longitudinal direction, rubber hardness of 70° (JIS A), modulus of repulsion elasticity of 10% (23° C.)

[blade temperature/modulus of repulsion elasticity=23/10=2.3], a plate thickness of 2 mm Lye and a free length 8 mm. The cleaning unit is constructed with a swinging angle of 10°, an abutting angle of 20° and total pressure force of 2.0 kgf against the transfer belt (pressure force of 2000/31.5=63.5 gf/cm per unit length of the blade).

As shown in FIG. 7, in Comparative Example 6, an image output endurance test was carried out in the construction as described above, with a result that under a low-temperature and low-humidity environment (15° C./10%), the follow-up property to the surface of the belt became inferior because of the low modulus of repulsion elasticity whereby bad cleaning occurred, and under a room temperature environment (23° C./55%) as well, friction scratches occurred on the surface of the transfer belt at about 1500,000 sheets, and an inconvenience actualized in images occurred.

The value of the blade temperature/modulus of repulsion elasticity may preferably be within the range of 0<(blade temperature/modulus of repulsion elasticity)<1.0. Generally, the value of modulus of repulsion elasticity tends to rise with the rise of temperature. Consequently, when the value of the blade temperature/modulus of repulsion elasticity exceeds 1, it represents the physical property that modulus of repulsion elasticity is low for temperature. Consequently, when the aforementioned value exceeds 1, the follow-up property of the blade is aggravated particularly at low temperatures and the cleaning performance becomes inferior.

An image forming apparatus according to Comparative Example 7 will now be described briefly. In Comparative Example 7, except for the transfer belt, the construction is similar to that of the aforedescribed fifth embodiment and therefore need not be described in detail. The transfer belt used in Comparative Example 7 has such physical property values as tensile strength 140,000 kgf/cm$^2$, Young's modulus $2.9\times10^4$ kgf/cm$^2$, surface roughness Rz 1.80 $\mu$m (produced by Kosaka Laboratory Ltd., length 0.8, cutoff 0.08) and initial coefficient of dynamic friction 0.2 (HEIDON, Tribogear Muse TYPE: 94 B).

As shown in FIG. 7, in Comparative Example 7, an image output endurance test was carried out in the construction as described above with a result that under a low-temperature and low-humidity environment (15° C./10%), bad cleaning occurred, and under a room temperature environment (23° C./55%) as well, friction scratches occurred on the surface of the transfer belt at about 1500,000 sheets, and an inconvenience actualized in images occurred.

In the construction as described above, the abutting pressure per unit length of the cleaning blade may preferably be equal to or greater than 15 gf/cm and equal to or less than 100 gf/cm. If it is less than 15 gf/cm, sufficient abutting pressure will not be obtained and bad cleaning may be caused. On the other hand, if it is greater than 100 gf/cm, an increase in driving torque, the turning-up of the blade and edge breakage or the like may be caused by the excessive abutting pressure.

Also, as regards the surface roughness Rz of the transfer belt, the initial surface roughness Rz may preferably be equal to or greater than 0.01 $\mu$m and equal to or less than 1.0 $\mu$m, and the surface roughness Rz of the bearing and conveying member when in the used state of the apparatus, the bearing and conveying member has made 10,000 revolutions may preferably be equal to or greater than 0.01 $\mu$m and equal to or less than 1.5 $\mu$m. If the surface roughness exceeds the aforementioned limitation, the bad cleaning due to the slipping-out of the developers and the edge breakage or the like of the blade may occur.

Also, the Young's modulus of the transfer belt may preferably be equal to or greater than $2.5\times10^4$ kgf/cm$^2$, and the tensile strength thereof may preferably be equal to or greater than 1,000 kgf/cm$^2$, and if they are less than these values, there may arise the problem that the transfer belt is liable to be worn and is inferior in durability and the surface roughness by endurance is liable to become great.

[Eighth Embodiment]

Another embodiment of the present invention will be described hereinafter. This embodiment is similar in basic construction to the aforedescribed first embodiment.

The cleaning blade 5 constituting the cleaning means for the transfer belt 71 is constructed with a length of 315 mm in a longitudinal direction, rubber hardness of 77° (JIS A), modulus of repulsion elasticity (JIS-K6255) of 45% (23° C.) [blade temperature/modulus of repulsion elasticity=23/45=0.51], a plate thickness of 2 mm and a free length of 8 mm. The cleaning unit is constructed with a swinging angle of 0°, an abutting angle of 25° and total pressure force of 1.5 kgf against the transfer belt 71 (pressure force of 1500/31.5=47.6 gf/cm per unit length in a longitudinal direction of the blade).

As shown in FIG. 8, in the eighth embodiment, in the construction as described above, the transfer belt 71 used a high-strength low-friction member having tensile strength of 3,200 kgf/cm$^2$, Young's modulus of $6.0\times10^4$ kgf/cm$^2$ and surface roughness Rz 0.92 $\mu$m (produced by Kosaka Laboratory Ltd., length 0.8, cutoff 0.08) to thereby prevent the abrasion wear (0.05 $\mu$m/10,000 revolutions) of the transfer belt 71 to the utmost, and bad cleaning and the reversal of the cleaning blade were not caused and bad images were not caused. As the result of image output endurance test, no inconvenience actualized in images was not seen in the above-described transfer belt for a long period of 1,000,000 sheets and in the cleaning blade for a long period of 500,000 sheets, and images of good quality were stably maintained.

[Ninth Embodiment]

An image forming apparatus according to a ninth embodiment will now be described briefly. In the present embodiment, except for the transfer belt, the construction is similar to that of the aforedescribed eighth embodiment and therefore need not be described in detail. The transfer belt 71 used in the present embodiment has such physical property values as tensile strength 1,500 kgf/cm$^2$, Young's modulus $3.2\times10^4$ kgf/cm$^2$ and surface roughness Rz 0.32 $\mu$m (produced by Kosaka Laboratory Ltd., length 0.8, cutoff 0.08).

As shown in FIG. 8, in the ninth embodiment, in the construction as described above, the abrasion wear of the surface of the transfer belt in the actual apparatus was 0.3 $\mu$m/10,000 revolutions. As the result of an image output endurance test, no inconvenience actualized in images was seen in the transfer belt for a long period of 1,000,000 sheets and in the cleaning blade for a long period of 500,000 sheets, and images of good quality were stably maintained.

[Tenth Embodiment]

An image forming apparatus according to a tenth embodiment will now be described briefly. In the present embodiment, except for the cleaning blade which is a cleaning member for the transfer belt, the construction is similar to that of the aforedescribed eighth embodiment and therefore need not be described in detail. In the present embodiment, the cleaning blade 5 constituting the cleaning means for the transfer belt 71 is constructed with rubber hardness of 70° (JIS A), modulus of repulsion elasticity of 30% (23° C.) [blade temperature/modulus of repulsion elasticity=23/30=0.77], a plate thickness of 2 mm and a free length of 8 mm. The cleaning unit is constructed with a swinging angle of 10°, an abutting angle of 20° and total pressure force of 1.7 kgf against the transfer belt 71 (abutting pressure of 1,700/31.5=54.0 gf/cm per unit length of the blade).

As shown in FIG. 8, in the tenth embodiment, in the construction as described above, the abrasion wear of the surface of the transfer belt in the actual apparatus was 0.05 $\mu$m/10,000 revolutions. As the result of an image output endurance test, no inconvenience actualized in images was seen in the transfer belt for a long period of 1,000,000 sheets and in the cleaning blade for a long period of 500,000 sheets, and images of good quality were stably maintained.

[Comparative Examples]

Two comparative examples with the above-described embodiment of the present invention will be exemplified below.

An image forming apparatus according to Comparative Example 8 will first be described briefly. In Comparative Example 8, except for the transfer belt, the construction is similar to that of the aforedescribed first embodiment and therefore need not be described in detail. The transfer belt used in Comparative Example 8 uses polycarbonate (PC) and has such physical property values as tensile strength 660 kgf/cm$^2$, Young's modulus $2.0\times10^4$ kgf/cm$^2$ and surface roughness Rz 0.60 $\mu$m (produced by Kosaka Laboratory Ltd., length 0.8, cutoff 0.08).

As shown in FIG. 8, in Comparative Example 8, in the construction as described above, the abrasion wear of the transfer belt in the actual apparatus was 2.0 $\mu$m/10,000 revolutions. An image output endurance test was carried out after the supply of 100,000 sheets with a result that the surface roughness of the transfer belt reached Rz 4.50 $\mu$m (produced by Kosaka Laboratory Ltd., length 0.8, cutoff 0.08) and streaky bad images were created.

An image forming apparatus according to Comparative Example 9 will now be described briefly. In Comparative Example 9, except for the cleaning blade constituting the cleaning means for the transfer belt, the construction is similar to that of the aforedescribed first embodiment and therefore need not be described in detail. In Comparative Example 9, the cleaning blade constituting the cleaning means for the transfer belt 71 is constructed with a length of 315 mm in a longitudinal direction, rubber hardness of 70° (JIS A), modulus of repulsion elasticity of 10% (23° C.) [blade temperature/modulus of repulsion elasticity=23/10=2.3], a plate thickness of 2 mm and a free length of 8 mm. The cleaning unit is constructed with a swinging angle of 10°, an abutting angle 20° and total pressure force of 2.0 kgf against the transfer belt (pressure force of 2,000/31.5=63.5 gf/cm per unit length of the blade).

As shown in FIG. 8, in Comparative Example 9, an image output endurance test was carried out in the construction as described above with a result that under a low-temperature and low-humidity environment (15°.C/10%), the follow-up property to the surface of the belt became inferior because of the low modulus of repulsion elasticity, whereby bad cleaning occurred, and under a room temperature environment (23° C./55%) as well, friction scratches occurred on the surface of the transfer belt at about 1500,000 sheets, and an inconvenience actualized in images occurred.

In the construction as described above, the pressure force of the cleaning blade is made equal to or greater than 15 gf/cm and equal to or less than 100 gf/cm and the abrasion wear of the transfer belt when it has made 10,000 revolutions is made equal to or greater than 0.01 $\mu$m and equal to or less than 1.0 $\mu$m, whereby stable cleaning ability can be obtained.

If use is made of a material of which the abrasion wear exceeds 1.0 $\mu$m, the service life of the belt itself will be shortened and the way of being shaved will become rough, and the possibility of causing bad cleaning will become high.

The cleaning devices in the above-described Embodiments 5 to 10 can also be used for the cleaning of the intermediate transfer belt to obtain a similar effect.

What is claimed is:

1. An image forming apparatus comprising:

image forming means for forming an image by a developer;

a bearing and conveying member for bearing thereon and conveying a transfer material on which a developer image is formed, or a developer image directly transferred thereto; and cleaning means for cleaning said bearing and conveying member, said cleaning means including a cleaning blade abutting against said bearing and conveying member, and holding means holding said cleaning blade and swingable about a rotary shaft, wherein an angle formed by a tangential line on an abutting portion of said cleaning blade against said bearing and conveying member with a line connecting a center of said rotary shaft and said abutting portion is equal to or greater than 0° and equal to or less than 15°, wherein said bearing and conveying member has physical property values of a Young's modulus of $2.5\times10^4$ kgf/cm$^2$ or greater and a tensile strength of 1,000 kgf/cm$^2$ or greater, and wherein an abrasion wear of a surface of said bearing and conveying member when in use of the apparatus, said bearing and conveying member having made 10,000 revolutions is equal to or greater than 0.01 $\mu$m and equal to or less than 1.0 $\mu$m.

2. An image forming apparatus according to claim 1, wherein a coefficient of initial dynamic friction of said bearing and conveying member is equal to or greater than 0.1 and equal to or less than 0.5.

3. An image forming apparatus according to claim 1, wherein said bearing and conveying member includes a polyimide resin layer on at least the surface of said bearing and conveying member.

4. An image forming apparatus according to claim 1, wherein said cleaning blade has a modulus of repulsion elasticity (%) of at least 0<[a blade temperature (° C.)]/[the modulus of repulsion elasticity (%)] <1.0 between 0° C. to 45° C.

5. An image forming apparatus according to claim 1, wherein said developer has an average particle diameter of 6 $\mu$m–10 $\mu$m, and a shape factor SF-1 of said developer is within a range of 100–140 and a shape factor SF-2 of said developer is within a range of 100–120.

6. An image forming apparatus according to any one of claims 1 and 2 through 5, wherein said image forming means includes a plurality of image bearing members bearing developer images thereon, and a transfer charging member for transferring the developer images borne on said plurality of image bearing members to the transfer material borne on said bearing and conveying member, and wherein the developer images are sequentially superimposed and transferred onto the transfer material borne on said bearing and conveying member.

7. An image forming apparatus according to any one of claims 1 and 2 through 5, wherein said image forming means includes a plurality of image bearing members bearing developer images thereon, a primary transfer charging member for sequentially superimposing and transferring the developer images borne on said plurality of image bearing members onto said bearing and conveying member, and a secondary transfer charging member for collectively transferring the superimposed developer images onto the transfer material.

8. An image forming apparatus comprising:

image forming means for forming an image by a developer;

a bearing and conveying member for bearing thereon and conveying a transfer material on which a developer image is formed, or a developer image directly transferred thereto; and cleaning means for cleaning said bearing and conveying member, said cleaning means being designed such that a pressure force of a cleaning blade abutting against said bearing and conveying member is equal to or greater than 15 gf/cm and equal to or less than 100 gf/cm, wherein an initial surface roughness Rz of said bearing and conveying member is equal to or greater than 0.01 $\mu$m and equal to or less than 1.0 $\mu$m, wherein said bearing and conveying member has physical property values of a Young's modulus of $2.5\times10^4$ kgf/cm$^2$ or greater and a tensile strength of 1,000 kgf/cm$^2$ or greater, and wherein a surface roughness Rz of said bearing and conveying member when in use of the apparatus, said bearing and conveying member having made 10,000 revolutions is equal to or greater than 0.01 $\mu$m and equal to or less than 1.5 $\mu$m.

9. An image forming apparatus according to claim 8, wherein a coefficient of initial dynamic friction of said bearing and conveying member is equal to or greater than 0.1 and equal to or less than 0.5.

10. An image forming apparatus according to claim 8, wherein said bearing and conveying member includes a polyimide resin layer on at least the surface of said bearing and conveying member.

11. An image forming apparatus according to claim 8, wherein said cleaning blade has a modulus of repulsion elasticity (%) of at least 0<[a blade temperature (° C.)]/[the modulus of repulsion elasticity (%)] <1.0 between 0° C. to 45° C.

12. An image forming apparatus according to claim 8, wherein said developer has an average particle diameter of 6 $\mu$m–10 $\mu$m, and a shape factor SF-1 of said developer is within a range of 100–140 and a shape factor SF-2 of said developer is within a range of 100–120.

13. An image forming apparatus according to claim 8, wherein said cleaning means includes holding means holding said cleaning blade and swingable about a rotary shaft, and an angle formed by a tangential line on an abutting portion of said cleaning blade against said bearing and conveying member with a line connecting a center of said rotary shaft and said abutting portion is equal to or greater than 0° and equal to or less than 15°.

14. An image forming apparatus according to any one of claims 8 and 9 through 13, wherein said image forming means includes a plurality of image bearing members bearing developer images thereon, and a transfer charging member for transferring the developer images borne on said plurality of image bearing members to the transfer material borne on said bearing and conveying member, and wherein the developer images are sequentially superimposed and transferred onto the transfer material borne on said bearing and conveying member.

15. An image forming apparatus according to any one of claims 8 and 9 through 13, wherein said image forming means includes a plurality of image bearing members bearing developer images thereon, a primary transfer charging member for sequentially superimposing and transferring the developer images borne on said plurality of image bearing members onto said bearing and conveying member, and a secondary transfer charging member for collectively transferring the superimposed developer images onto the transfer material.

16. An image forming apparatus comprising:

image forming means for forming an image by a developer;

a bearing and conveying member for bearing thereon and conveying a transfer material on which a developer image is formed, or a developer image directly transferred thereto; and cleaning means for cleaning said bearing and conveying member, said cleaning means being designed such that a pressure force of a cleaning blade abutting against said bearing and conveying member is equal to or greater than 15 gf/cm and equal to or less than 100 gf/cm, wherein said bearing and conveying member has physical property values of a Young's modulus of $2.5\times10^4$ kgf/cm$^2$ or greater and a tensile strength of 1,000 kgf/cm$^2$ or greater, and wherein an abrasion wear of a surface of said bearing and conveying member when in use of the apparatus, said bearing and conveying member having made 10,000 revolutions is equal to or greater than 0.01 $\mu$m and equal to or less than 1.0 $\mu$m.

17. An image forming apparatus according to claim 16, wherein a coefficient of initial dynamic friction of said bearing and conveying member is equal to or greater than 0.1 and equal to or less than 0.5.

18. An image forming apparatus according to claim 16, wherein said bearing and conveying member includes a polyimide resin layer on at least the surface of said bearing and conveying member.

19. An image forming apparatus according to claim 16, wherein said cleaning blade has a modulus of repulsion elasticity (%) of at least 0<[a blade temperature (° C.)]/[(the modulus of repulsion elasticity (%)]≦1.0 between 0° C. to 45° C.

20. An image forming apparatus according to claim 16, wherein said developer has an average particle diameter of 6 $\mu$m–10 $\mu$m, and a shape factor SF-1 of said developer is within a range of 100–140 and a shape factor SF-2 of said developer is within a range of 100–120.

21. An image forming apparatus according to claim 16, wherein said cleaning means includes holding means holding said cleaning blade and swingable about a rotary shaft, and an angle formed by a tangential line on an abutting portion of said cleaning blade against said bearing and conveying member with a line connecting a center of said rotary shaft and said abutting portion is equal to or greater than 0° and equal to or less than 15°.

22. An image forming apparatus according to any one of claims 16 and 17 through 21, wherein said image forming means includes a plurality of image bearing members bearing developer images thereon, and a transfer charging member for transferring the developer images borne on said plurality of image bearing members to the transfer material borne on said bearing and conveying member, and wherein the developer images are sequentially superimposed and transferred onto the transfer material borne on said bearing and conveying member.

23. An image forming apparatus according to any one of claims 16 and 17 through 21, wherein said image forming means includes a plurality of image bearing members bearing developer images thereon, a primary transfer charging member for sequentially superimposing and transferring the developer images borne on said plurality of image bearing members onto said bearing and conveying member, and a secondary transfer charging member for collectively transferring the superimposed developer images onto the transfer material.

* * * * *

UNITED STATES PATENT AND TRADEMARK OFFICE

CERTIFICATE OF CORRECTION

PATENT NO. : 6,522,856 B2
DATED : February 18, 2003
INVENTOR(S) : Yuji Nakayama

It is certified that error appears in the above-identified patent and that said Letters Patent is hereby corrected as shown below:

Title page,
Item [56], References Cited, U.S. PATENT DOCUMENTS,
"3,660,862" should read -- 3,660,863 --; and
"8/2000 Hard et al." should read -- 8/2000 Hara et al --.
Item [57], ABSTRACT,
Line 7, "has" should read -- having --;
Line 18, "revolutions" should read -- revolutions, --.

Column 1,
Line 27, "is, the" should read -- is, to --;
Line 28, "expendable," should read -- expendables, --;
Line 36, "equivalent" should read -- equivalent to analog machines, but full-color printers equivalent --; and Column 2,
Line 30, "device, not shown," should read -- device (not shown). --;
Line 34, "cassette, not shown," should read -- cassette (not shown), --.

Column 4,
Line 42, "generated heat" should read -- heat generated --;
Line 58, "continues" should read -- continuous --; and
Line 59, "of a" should read -- of --.

Column 5,
Line 2, "g" should read -- μ --; and
Line 55, "μand" should read -- μm and --.

Column 7,
Line 21, "sensor, not shown," should read -- sensor (not shown), --.

Column 10,
Line 6, "source, not shown," should read -- source (not shown), --;
Line 20, "device, not shown," should read -- device (not shown), --.

Column 12,
Line 60, ".means" should read -- means --.

UNITED STATES PATENT AND TRADEMARK OFFICE

CERTIFICATE OF CORRECTION

PATENT NO. : 6,522,856 B2
DATED : February 18, 2003
INVENTOR(S) : Yuji Nakayama

It is certified that error appears in the above-identified patent and that said Letters Patent is hereby corrected as shown below:

Column 13,
Line 27, "stain" should read -- strain --;
Line 33, "angle e" should read -- angel θ --; and
Line 40, "less" (2nd occurrence) should read -- more --.

Column 15,
Line 62, "apparatus, not" should read -- apparatus (not --; and
Line 63, "shown," should read -- shown), --.

Column 16,
Line 27, "**110*y*-101*k*," should read -- 101*y*-101*k***, --;
Lines 30, 34 and 64,"**110*y*-101*k*." should read -- 101*y*-101*k***. --;
Line 46, "source, not shown," should read -- source (not shown), --; and
Line 61, "**110*y*-101*k*" should read -- 101*y*-101*k*** --;

Column 17,
Line 8, "source, not" should read -- source (not -- and
"shown," should read -- shown), --.

Column 21,
Line 2, "Lye" should be deleted;
Line 14, "1500,000" should read -- 150,000 --;
Line 18, "‹ 1.0." should read -- ≤ 1.0. --; and
Line 44, "1500,000" should read -- 150,000 --.

Column 22,
Line 5, "durability" should read -- durability, --.

Column 24,
Line 47, "‹ 1.0" should read -- ≤ 1.0 --;
Line 55, "1 and 2 through 5," should read -- 1 through 5, --; and
Line 65, "1 and 2 through 5," should read -- 1 through 5, --.

Column 25,
Line 43, "‹ 1.0" should read -- ≤ 1.0 --; and
Line 59, "8 and 9 through 13," should read -- 8 through 13, --.

UNITED STATES PATENT AND TRADEMARK OFFICE

CERTIFICATE OF CORRECTION

PATENT NO. : 6,522,856 B2 
DATED : February 18, 2003
INVENTOR(S) : Yuji Nakayama It is certified that error appears in the above-identified patent and that said Letters Patent is hereby corrected as shown below:

Column 26,
Line 2, "8 and 9 through 13," should read -- 8 through 13, --;
Line 44, "/[(the" should read -- / [the --; and
Line 61, "16 and 17 through 21," should read -- 16 through 21, --.

Column 27,
Line 4, "16 and 17 through 21," should read -- 16 through 21, --.

Signed and Sealed this

Second Day of December, 2003

JAMES E. ROGAN
*Director of the United States Patent and Trademark Office*